US007150517B2

(12) United States Patent
Satake

(10) Patent No.: US 7,150,517 B2
(45) Date of Patent: Dec. 19, 2006

(54) METHOD FOR DRIVING PIEZOELECTRIC INK JET HEAD

(75) Inventor: Kenichi Satake, Soraku-gun (JP)

(73) Assignee: Kyocera Corporation, Kyoto (JP)

( * ) Notice: Subject to any disclaimer, the term of this patent is extended or adjusted under 35 U.S.C. 154(b) by 240 days.

(21) Appl. No.: 10/807,673

(22) Filed: Mar. 24, 2004

(65) Prior Publication Data

US 2004/0189752 A1 Sep. 30, 2004

(30) Foreign Application Priority Data

Mar. 28, 2003 (JP) ..... 2003-092655
Mar. 28, 2003 (JP) ..... 2003-092659

(51) Int. Cl.
*B41J 2/45* (2006.01)
*B41J 29/38* (2006.01)

(52) U.S. Cl. ..... 347/68; 347/10; 347/11

(58) Field of Classification Search ..... 347/68, 347/10

See application file for complete search history.

(56) References Cited

U.S. PATENT DOCUMENTS 5,510,816 A * 4/1996 Hosono et al. ..... 347/10
6,149,258 A 11/2000 Kimura ..... 347/10
6,189,992 B1 2/2001 Suzuki ..... 347/14
6,206,496 B1 3/2001 Ushioda ..... 347/10
6,241,345 B1 * 6/2001 Ushioda ..... 347/68
6,276,772 B1 * 8/2001 Sakata et al. ..... 347/10
6,886,898 B1 * 5/2005 Kojoh et al. ..... 347/10

FOREIGN PATENT DOCUMENTS

| | | |
|---|---|---|
| EP | 0 925 922 | 6/1999 |
| EP | 1 123 806 | 8/2001 |
| EP | 1 155 863 | 11/2001 |
| JP | 02-192947 | 7/1990 |
| JP | 05-318731 | 3/1993 |

* cited by examiner

*Primary Examiner*—K. Feggins
*Assistant Examiner*—Shelby Fidler
(74) *Attorney, Agent, or Firm*—Hogan & Hartson LLP

(57) ABSTRACT

The present invention provides a method for driving a piezoelectric ink jet head that surely suppresses the ensuing vibration of the drive section while suppressing the flying speed of the ink droplet from decreasing, by setting the time constant $\tau_{UP}$ of rise of voltage when the drive voltage is applied and/or the time constant $\tau_{DN}$ of fall of voltage when stopping the application of the drive voltage are set in ranges that satisfy the relations of the expressions (i) and (ii):

$$Ta/(-\ln 0.01) \leqq \tau_{UP} \leqq Ta/(-\ln 0.25) \quad \text{(i)}$$

$$Ta/(-\ln 0.01) \leqq \tau_{DN} \leqq Ta/(-\ln 0.25) \quad \text{(ii)}$$

with respect to the period Ta of the ensuing vibration of the drive section, or pulse width $T_3$ of the drive voltage is set at an integral multiple of the period Ta of the ensuing vibration of the drive section.

5 Claims, 12 Drawing Sheets

METHOD FOR DRIVING PIEZOELECTRIC INK JET HEAD

This disclosure of Japanese Patent Application Serial Nos. 2003-92655 and 2003-92659 filed on Mar. 28, 2003, is incorporated herein by reference.

TECHNICAL FIELD

The present invention relates to a method for driving a piezoelectric ink jet head and, more particularly, to a method for driving a piezoelectric ink jet head that can be preferably used in printer, copier, facsimile, and a composite machine which combines some of the former.

BACKGROUND OF THE INVENTION

An on-demand type inkjet printer employs a piezoelectric ink jet head that comprises a pressure chamber 2 filled with an ink, a nozzle 3 that communicates with the pressure chamber 2 and has ink meniscus formed inside thereof from the ink that fills the pressure chamber 2, a piezoelectric element 9 that is deformed when a drive voltage is applied, and an oscillator plate 7 that is stacked on the piezoelectric element 9 so as to form a drive section D, as shown in FIGS. 2 and 3.

In the piezoelectric ink jet head, the drive section D transmits a force generated by the piezoelectric element 9 as a pressure to the ink contained in the pressure chamber 2 thereby to function as a drive power source that discharges ink droplets through the nozzle 3 that communicates with the pressure chamber 2. That is, in the drive section D, as the piezoelectric element 9 deforms due to a drive voltage applied thereto, the oscillator plate 7 is caused to deflect so as to protrude toward the pressure chamber 2 as indicated by dot and dash line in FIG. 2, thereby decreasing the volume of the pressure chamber 2 and pressurizing the ink in the pressure chamber 2, so that ink droplet is discharged from the tip of the nozzle 3.

At the same time, since the oscillator plate 7 is also caused by the pressure of the ink contained in the pressure chamber 2 to deflect in a direction opposite to that shown in the drawing, the drive section D also acts as an elastic body with respect to the vibration of the ink in the head.

When a voltage is applied to the piezoelectric element 9 so as to generate a force, the ink contained in the head experiences vibration under the pressure transmitted via the oscillator plate 7 from the drive section D. This vibration is generated with the drive section D and the pressure chamber 2 acting as the elasticity against the inertia of a feeder port 5 for feeding the ink to the pressure chamber 2, a nozzle passage 4 that communicates the pressure chamber 2 and the nozzle 3, and the nozzle 3. Natural period of vibration of the ink contained in the head during this vibration is determined by the dimensions of the components described above, physical properties of the ink and dimensions and physical properties of the drive section D.

In the piezoelectric ink jet head, an ink droplet is discharged by utilizing the vibration of ink meniscus in the nozzle 3 due to the vibration of the ink described above.

As described in Japanese Unexamined Patent Publication JP-H02-192947-A2 (1990), the piezoelectric ink jet head generally employs such a drive method as described below. A constant drive voltage is continuously applied to a piezoelectric element in the state of standby so that the piezoelectric element is kept deformed and the oscillator plate continue to deflect, thereby to maintain the pressure chamber in a state of decreased volume. To form a dot, (1) the drive voltage is removed immediately before forming the dot so as to cancel the deformation of the piezoelectric element and cancel the deflection of the oscillator plate, thereby increasing the volume of the pressure chamber with the ink meniscus in the nozzle being pulled toward the pressure chamber, then (2) the drive voltage is applied again so as to cause the piezoelectric element to deform and the oscillator plate to deflect, thereby decreasing the volume of the pressure chamber and discharge an ink droplet through the tip of the nozzle. This drive method may be referred to as the "Pull-push drive method"in the following description.

FIG. 17 is a simplified graph showing the relation between drive voltage waveform (indicated by a thick dot and dash line) of drive voltage $V_p$ applied to the piezoelectric element and changes in volumetric velocity of ink [indicated by thick solid line with the ink discharging direction indicated by (+)] in the nozzle when the drive voltage waveform is applied with the Pull-push drive method.

This drive method will be described below taking an example in such a case that employs the piezoelectric element 9 of transverse vibration mode formed in a flat plate or layer of small thickness, which contracts in the direction of plane when a drive voltage is applied, as shown in FIGS. 2 and 3.

In the standby period to the left of $t_1$, in FIG. 17, drive voltage $V_p$ is maintained at $V_H$ ($V_p=V_H$) so that the piezoelectric element continues to contract in the direction of plane thereby keeping the oscillator plate to deflect in a constant shape so as to maintain the pressure chamber in the state of reduced volume, during which the ink in the head remains stationary, namely the volumetric velocity of ink in the nozzle remains zero.

In order to discharge an ink droplet through the nozzle so as to form a dot on a sheet of paper, the drive voltage $V_p$ applied to the piezoelectric element is removed ($V_p=0$) at time $t_1$, immediately before the formation so as to cancel the contraction of the piezoelectric element in the direction of plane and cancel the deflection of the oscillator plate.

This results in a predetermined amount of increase in the volume of the pressure chamber, and therefore a quantity of ink in the nozzle corresponding to the volume increase is pulled toward the pressure chamber with ink meniscus drawn thereby. During this step, volumetric velocity of the ink in the nozzle increases in the direction of (−), and then gradually decreases to approach zero as indicated in the period from $t_1$ to $t_2$ in FIG. 17. These changes occur in about a half of the natural period of vibration $T_1$ of the volumetric velocity of ink indicated by thick solid line in the drawing.

At time $t_2$ when the volumetric velocity of ink in the nozzle has approached zero, the drive voltage $V_p$ is applied again to the value of $V_H$ ($V_p=V_H$) so that the piezoelectric element contracts in the direction of plane thereby to cause the oscillator plate to deflect. This operation is equivalent to the application of such a drive voltage $V_p$ to the piezoelectric element that has drive voltage waveform of pulse width $T_3$ that is one half of the natural period of vibration $T_1$, as indicated by thick dot and dash line.

This causes a pressure to be exerted by the ink that has been pushed out of the pressure chamber, as the oscillator plate deflects to decrease the volume of the pressure chamber at the time when the ink meniscus is about to return in the direction (+) from the state of being pulled toward the pressure chamber with a maximum displacement (state of zero volumetric velocity at time $t_2$). As a result, the ink protrudes significantly from the tip of the nozzle in the direction of (+). Since the ink protruding from the nozzle tip has an appearance of substantially cylindrical shape, the ink in the protruded state is generally called the ink column. When the ink column has extended to the maximum, a droplet departs from the distal end of the ink column, flies and reaches the paper surface, thereby to form a dot.

The piezoelectric ink jet head generally may employ such a drive method as: a piezoelectric element in the state of standby is maintained in such a condition that drive voltage is not applied thereto, and when forming a dot, (I) the drive voltage is applied immediately before forming the dot so as to cause the piezoelectric element to contract and the oscillator plate to deflect, thereby decreasing the volume of the pressure chamber so that the ink meniscus in the nozzle is pushed toward the tip of the nozzle and the ink protrudes from the tip of the nozzle like a column (ink column), then (II) the drive voltage is removed again so as to cancel the contraction of the piezoelectric element and cancel the deflection of the oscillator plate, thereby increasing the volume of the pressure chamber and pulling back the ink column that has been protruding from the tip of the nozzle into the nozzle, thereby to separate an ink droplet. This drive method may be referred to as the "Push-pull drive method" in the following description.

FIG. 18 is a simplified graph showing the relation between the drive voltage waveform of the drive voltage $V_p$ applied to the piezoelectric element and changes in the volumetric velocity of ink in the nozzle when the drive voltage waveform is applied with the Push-pull drive method.

This drive method will be described below.

In the standby period to the left of $t_1$ in FIG. 18, the drive voltage $V_p$ is not applied ($V_p$=0) so that the volume of the pressure chamber remains at the initial value, and the volumetric velocity of ink in the nozzle remains zero.

In order to discharge an ink droplet through the nozzle so as to form a dot on a sheet of paper, the drive voltage $V_p$ applied to the piezoelectric element is increased to $V_H$ ($V_p$=$V_H$) at time $t_1$ immediately before the dot formation so as to cause the piezoelectric element to contract in the direction of plane and the oscillator plate to deflect.

This results in a predetermined amount of decrease in the volume of the pressure chamber, and therefore a quantity of ink in the nozzle corresponding to the volume decrease is pushed toward the outside of the nozzle together with ink meniscus. During this step, volumetric velocity of the ink in the nozzle increases in the direction of (+) to reach a maximum, then decreases to approach zero,then increases in the direction of (−) to reach a maximum, and then decreases to approach zero as indicated in the period from $t_1$ to $t_2$ in FIG. 18. These changes occur in the natural period of vibration $T_1$ of the volumetric velocity of ink indicated by a thick solid line in the drawing.

Movement of the ink during the step described above is as follows. First, the ink in the nozzle is pushed toward the outside of the nozzle by the first deflection of the oscillator plate. Then as the volumetric velocity of the ink in the nozzle increases in the direction of (−) due to the intrinsic vibration of the ink, a force to pull the ink back into the nozzle acts on the ink that has been pushed toward the outside of the nozzle. However, since front of the ink that has been pushed toward the outside of the nozzle continues to move toward the outside, the ink is prolonged from the ink meniscus toward the outside, so that the ink column is formed.

At time $t_2$ when the volumetric velocity of ink in the nozzle has passed the point of zero, the drive voltage $V_p$ is removed again ($V_p$=0) so as to cancel the contraction of the piezoelectric element in the direction of plane thereby to cancel the deflection of the oscillator plate. This operation is equivalent to the application of such a drive voltage $V_p$ to the piezoelectric element that has a drive voltage waveform of pulse width $T_3$ which is proximate to the natural period of vibration $T_1$, as indicated by a thick dot and dash line.

While the ink meniscus in the nozzle is at the deepest position retracted toward the pressure chamber at the time when the volumetric velocity of the ink in the nozzle is zero, it is then urged to move again toward the outside of the nozzle by the intrinsic vibration of the ink. That is, at time $t_2$, the ink meniscus in the nozzle is in the course of moving from the deepest position retracted toward the pressure chamber toward the outside of the nozzle.

Consequently, if the ink is vibrated with reverse phase by canceling the deflection of the oscillator plate and increasing the volume of the pressure chamber at time $t_2$, the movement of the ink meniscus described above is suppressed so that the ink column is separated and an ink droplet is formed. As the ink droplet reaches the paper surface, a dot is formed on the paper.

In the piezoelectric ink jet head driven by the Pull-push or the Push-pull drive method described above, the drive section comprising the piezoelectric element and the oscillator plate vibrates at a natural frequency thereof. Period of the vibration is as small as a few tenths to a fifth of pulse width $T_3$ of the drive voltage waveform.

Making a description by way of the Pull-push drive method, the natural vibration is superposed as ensuing vibration over the vibration of the volumetric velocity of the ink during the formation of ink droplet as shown in FIG. 19. This results in the problem of fluctuations in the volume and flying speed of the ink droplet due to a deviation between the timing of drive voltage waveform to rise and the phase of ensuing vibration.

That is, in case the drive voltage waveform rises at a time when the speed of ensuing vibration is increasing toward the pressure chamber, the ink droplet grows in volume and the flying speed increases. When the drive voltage waveform rises at a time when the speed of ensuing vibration is decreasing toward the pressure chamber, on the other hand, volume of the ink droplet and the flying speed decrease.

As a consequence, a slightest variation in the pulse width of the drive voltage waveform results in significant variations in the volume of the ink droplet and the flying speed.

Also because thickness of the piezoelectric element and the conditions of bonding onto the oscillator plate vary among the plurality of piezoelectric elements disposed on the piezoelectric ink jet head, there are differences in the natural period of vibration among the drive sections. As a result, there occur variations in the volume of the ink droplet and the flying speed among the nozzles, even when the pulse width of the drive voltage waveform is maintained constant.

These problems arise similarly in the Push-pull drive method.

In order to suppress the ensuing vibration of the drive section, Japanese Unexamined Patent Publication JP-H05-318731-A1 (1993) proposes such a Pull-push drive method as described below. Time constant of decreasing voltage is set at 0.9 times the natural period of vibration of the drive section or longer when the drive voltage waveform falls, namely when removing the drive voltage $V_p$ from $V_H$ to zero at time $t_1$ in FIG. 17, and time constant of increasing voltage is set in a range from 0.9 to 1.2 times the natural period of vibration when the drive voltage waveform rises, namely when applying the drive voltage $V_p$ from zero to $V_H$ at time $t_2$ in FIG. 17.

It is true that ensuing vibration of the drive section can be suppressed by increasing the time constant of rise/fall. However, increasing the time constant of rise/fall leads to another problem that the flying speed of ink droplet decreases.

Japanese Patent Unexamined Publication JP-H05-318731-A1 employs a piezoelectric element longitudinal vibration mode that is formed in the shape of a thick plate or a rod having a predetermined cross section that expands in the direction of plate thickness or longitudinal direction of the rod when subjected to a drive voltage.

Since a piezoelectric element of longitudinal vibration mode has smaller natural period of vibration of the drive section compared to one of transverse vibration mode, the flying speed of ink droplet does not decrease significantly even when the time constant of rise/fall of drive voltage waveform is made as long as similar to the natural period of vibration of the drive section.

However, the piezoelectric element 9 of transverse vibration mode shown in FIGS. 2 and 3 has larger natural period of vibration of the drive section than that of longitudinal vibration mode. As a result, the flying speed of ink droplet decreases significantly when the time constant of rise/fall of drive voltage waveform is made as long as similar to the natural period of vibration of the drive section.

SUMMARY OF THE INVENTION

An object of the present invention is to provide a novel drive method that can suppress ensuing vibration of the drive section while restricting the flying speed of ink droplet from decreasing significantly in a piezoelectric ink jet head having a piezoelectric element of transverse vibration mode.

Another object of the present invention is to provide a novel drive method that can suppress the ensuing vibration of the drive section regardless of the vibration mode of the piezoelectric element.

In order to solve the problems described above, the present inventors have closely studied the relation between the time constant of rise/fall of drive voltage waveform and the natural period of vibration of the drive section in a piezoelectric ink jet head that employs a piezoelectric element of transverse vibration mode.

Through the research, it has been found that it is effective in restricting the flying speed of ink droplet from decreasing and suppressing the ensuing vibration of the drive section, to make the time required for the drive voltage $V_p$ to fall to 1–25% of $V_H$ equal to the period Ta of the ensuing vibration of the drive section which is superposed on the vibration waveform of the volumetric velocity of ink during fall of the drive voltage waveform, and/or to make the time required for the drive voltage $V_p$ to rise to 75–99% of $V_H$ equal to the period Ta during rise of the drive voltage waveform.

Specifically, time constant $\tau_{UP}$ of rise of the drive voltage $V_p$ in the drive voltage waveform of the piezoelectric ink jet head is set in a range that satisfies the relation of the expression (i):

$$Ta/(-\ln 0.01) \leqq \tau_{UP} \leqq Ta/(-\ln 0.25) \quad \text{(i)}$$

with respect to the period Ta of the ensuing vibration of the drive section that is superposed on the vibration waveform of the volumetric velocity of ink in the head, or time constant $\tau_{DN}$ of fall of the drive voltage $V_p$ is set in a range that satisfies the relation of the expression (ii)

$$Ta/(-\ln 0.01) \leqq \tau_{DN} \leqq Ta/(-\ln 0.25) \quad \text{(ii)}$$

with respect to the period Ta. Alternatively, both time constants are set as described above at the same time.

When the piezoelectric ink jet head that employs the piezoelectric element of transverse vibration mode is driven with the drive voltage waveform having parameters being set as described above, decrease in the flying speed of ink droplet is only about 10% of that in the case of driving with a drive voltage waveform in which time constants $\tau_{UP}$ and $\tau_{DN}$ are both set near zero as usual. Moreover, it is made possible to suppress the ensuing vibration of the drive section that is superposed on the vibration of volumetric velocity of ink in the nozzle.

Thus the invention according to claim 1 is a method for driving a piezoelectric ink jet head composed of:

a pressure chamber filled with an ink;

a nozzle that communicates with the pressure chamber and has an ink meniscus formed therein from the ink that fills the pressure chamber;

a piezoelectric element of transverse vibration mode that contracts in the direction of plane when subjected to a drive voltage applied thereto; and an oscillator plate that is stacked on the piezoelectric element so as to constitute a drive section and deflects so as to decrease the volume of the pressure chamber as the piezoelectric element contracts in the direction of plane when a voltage is applied thereto, so as to pressurize the ink in the pressure chamber and discharge an ink droplet from the tip of the nozzle, and wherein the piezoelectric ink jet head is operated by combining:

(A) the step of applying a drive voltage to the piezoelectric element so that the piezoelectric element contracts in the direction of plane and the oscillator plate deflects, thereby decreasing the volume of the pressure chamber, and (B) the step of removing the drive voltage applied to the piezoelectric element so that the contraction of the piezoelectric element in the direction of plane is canceled and consequently the deflection of the oscillator plate is canceled, thereby increasing the volume of the pressure chamber, thereby to discharge an ink droplet from the tip of the nozzle, characterized in that the piezoelectric element is driven with a drive voltage waveform that has at least one of the following settings:

(a) time constant $\tau_{UP}$ of rise of the drive voltage in the step (A) is set in a range that satisfies the relation of the expression (i):

$$Ta/(-\ln 0.01) \leqq \tau_{UP} \leqq Ta/(-\ln 0.25) \quad \text{(i)}$$

with respect to the period Ta of the ensuing vibration of the drive section which is superposed on the vibration waveform of the volumetric velocity of ink in the head, (b) time constant $\tau_{DN}$ of fall of the drive voltage in the step (B) is set in a range that satisfies the relation of the expression (ii):

$$Ta/(-\ln 0.01) \leqq \tau_{DN} \leqq Ta/(-\ln 0.25) \quad \text{(ii)}$$

with respect to the period Ta.

The constitution of the present invention described above can be preferably applied to the Pull-push drive method.

The invention according to claim 2 is a method for driving the piezoelectric ink jet head of claim 1, wherein the piezoelectric ink jet head is operated as follows:

a constant drive voltage is continuously applied to the piezoelectric element during a period of standby so that the piezoelectric element is kept contracted in the direction of plane and the oscillator plate continues to deflect, thereby to maintain the pressure chamber in a state of decreased volume and, during a period of forming a dot, (1) the drive voltage is removed immediately before forming the dot so as to cancel the contraction of the piezoelectric element and relieve the oscillator plate of deflection, thereby increasing the volume of the pressure chamber and pulling the ink meniscus in the nozzle back toward the pressure chamber, then (2) the drive voltage is applied again so as to cause the piezoelectric element to contract and the oscillator plate to deflect, thereby decreasing the volume of the pressure chamber and discharge an ink droplet through the tip of the nozzle.

The constitution of the present invention described above can also be preferably applied to the Push-pull drive method.

The invention according to claim 3 is a method for driving the piezoelectric ink jet head of claim 1, wherein the piezoelectric ink jet head is operated as follows:

the piezoelectric element in the state of standby is maintained in such a condition that drive voltage is not applied thereto, and during a period of forming a dot, (I) the drive voltage is applied immediately before forming the dot so as to cause the piezoelectric element to contract and the oscillator plate to deflect, thereby decreasing the volume of the pressure chamber, pushing the ink meniscus in the nozzle toward the tip of the nozzle and protruding the ink from the tip of the nozzle like a column, then (II) the drive voltage is removed again so as to cancel the contraction of the piezoelectric element and cancel the deflection of the oscillator plate, there by increasing the volume of the pressure chamber and pulling back the ink column that has been protruding from the tip of the nozzle into the nozzle, thereby separate an ink droplet.

In order to further improve the effect of suppressing the ensuing vibration of the drive section, it is preferable that the time constant $\tau_{UP}$ of rise of drive voltage $V_p$ is especially in a range defined by the relation of the expression (i-1):

$$Ta/(-\ln 0.05) \leqq \tau_{UP} \leqq Ta/(-\ln 0.25) \quad \text{(i-1)}$$

within the range described above.

The invention according to claim 4 is directed to a method of driving the piezoelectric ink jet head of claim 1, wherein the time constant $\tau_{UP}$ of rise of the drive voltage in the step (A) is set so as to satisfy the relation of the expression (i-1):

$$Ta/(-\ln 0.05) \leqq \tau_{UP} \leqq Ta/(-\ln 0.25) \quad \text{(i-1)}$$

with respect to the period Ta.

The time constant $\tau_{DN}$ of fall of the drive voltage $V_p$, too, is preferably set especially in a range defined by the relation of the expression (ii-1):

$$Ta/(-\ln 0.05) \leqq \tau_{DN} \leqq Ta/(-\ln 0.25) \quad \text{(ii-1)}$$

within the range described above, in order to further improve the effect of suppressing the ensuing vibration of the drive section.

The invention according to claim 5 is a directed to a method of driving the piezoelectric ink jet head of claim 1, wherein the time constant $\tau_{DN}$ of fall of the drive voltage in the step (B) is set in a range that satisfies the relation of the expression (ii-1):

$$Ta/(-\ln 0.05) \leqq \tau_{DN} \leqq Ta/(-\ln 0.25) \quad \text{(ii-1)}$$

with respect to the period Ta.

The present inventors also have researched closely on the relation between the pulse width of the drive voltage waveform and the ensuing vibration of the drive section.

Through the research, it was found that it is effective for suppressing the ensuing vibration of the drive section to set the pulse width $T_3$ of the drive voltage waveform at an integral multiple of the period Ta of the ensuing vibration of the drive section that is superposed on the vibration waveform of the volumetric velocity of the ink in the head.

When the pulse width $T_3$ of the drive voltage waveform is set at an integral multiple of the period Ta, the drive section is subject to vibrations of opposite phases as the drive voltage waveform rise or fall at a time when the ensuing vibration of the drive section caused by the fall or rise of the drive voltage waveform has completed an even number of half periods, namely an integral multiple of the period, so that the two vibrations cancel each other, thereby suppressing the subsequent ensuing vibration of the drive section.

This makes it possible to surely suppress the ensuing vibration of the drive section without controlling the rise/f all of the drive voltage waveform to have larger time constant for lower flying speed of ink droplet. This is effective regardless of the vibration mode of the piezoelectric element, namely in both a piezoelectric element of transverse vibration mode and a piezoelectric element of longitudinal vibration mode.

Thus the invention further comprises a method for driving a piezoelectric ink jet head composed of:

a pressure chamber filled with an ink;

a nozzle that communicates with the pressure chamber and has an ink meniscus formed therein from the ink that fills the pressure chamber;

a piezoelectric element that deforms when subjected to a drive voltage applied thereto; and an oscillator plate that is stacked on the piezoelectric element so as to constitute a drive section and deflects so as to decrease the volume of the pressure chamber as the piezoelectric element deforms when a voltage is applied thereto, so as to pressurize the ink in the pressure chamber and discharge an ink droplet from the tip of the nozzle, and wherein the piezoelectric ink jet head is operated by combining (A) the step of applying the drive voltage to the piezoelectric element so that the piezoelectric element deforms and the oscillator plate deflects, thereby decreasing the volume of the pressure chamber, and (B) the step of removing the drive voltage applied to the piezoelectric element so that the deformation of the piezoelectric element is canceled and consequently the deflection of the oscillator plate is canceled, thereby increasing the volume of the pressure chamber, thereby to discharge an ink droplet from the tip of the nozzle, characterized in that the piezoelectric element is driven with a drive voltage waveform of which pulse width $T_3$ of the drive voltage waveform between the rise of the drive voltage in the step (A) and the fall of the drive voltage in the step (B) is set at an integral multiple of the period Ta of the ensuing vibration of the drive section that is superposed on the vibration waveform of the volumetric velocity of ink in the head.

The constitution of the present invention described above can also be preferably applied to the Pull-push drive method.

The invention further comprises a method for driving the piezoelectric ink jet head, wherein the piezoelectric ink jet head is operated as follows:

a constant drive voltage is continuously applied to the piezoelectric element during a period of standby so that the piezoelectric element is kept deformed and the oscillator plate continues to deflect, thereby to maintain the pressure chamber in a state of decreased volume and, during a period of forming a dot, (1) the drive voltage is removed immediately before forming the dot so as to cancel the deformation of the piezoelectric element and relieve the oscillator plate of deflection, thereby increasing the volume of the pressure chamber and pulling the ink meniscus in the nozzle back toward the pressure chamber, then (2) the drive voltage is applied again so as to cause the piezoelectric element to deform and the oscillator plate to deflect, thereby decreasing the volume of the pressure chamber and discharge an ink droplet through the tip of the nozzle, and (3) pulse width $T_3$ of the drive voltage waveform from the fall of the drive voltage in the step (1) to the rise of the drive voltage in the step (2) is set at an integral multiple of the period Ta of the ensuing vibration of the drive section.

The constitution of the present invention described above can also be preferably applied to the Push-pull drive method.

The invention further comprises is a method for driving the piezoelectric ink jet head, wherein the piezoelectric ink jet head is operated as follows:

the piezoelectric element in the state of standby is maintained in such a condition that drive voltage is not applied thereto, and during a period of forming a dot, (I) the drive voltage is applied immediately before forming the dot so as to cause the piezoelectric element to deform and the oscillator plate to deflect, thereby decreasing the volume of the pressure chamber, pushing the ink meniscus in the nozzle toward the tip of the nozzle and protruding the ink from the tip of the nozzle like a column, then (II) the drive voltage is removed again so as to cancel the deformation of the piezoelectric element and cancel the deflection of the oscillator plate, there by increasing the volume of the pressure chamber and pulling back the ink column that has been protruding from the tip of the nozzle into the nozzle, thereby to separate an ink droplet, and (III) pulse width $T_3$ of the drive voltage waveform from the rise of the drive voltage in the step (I) to the fall of the drive voltage in the step (II) is set at an integral multiple of the period Ta of the ensuing vibration of the drive section.

DESCRIPTION OF PREFERRED EMBODIMENTS

Figure 1:
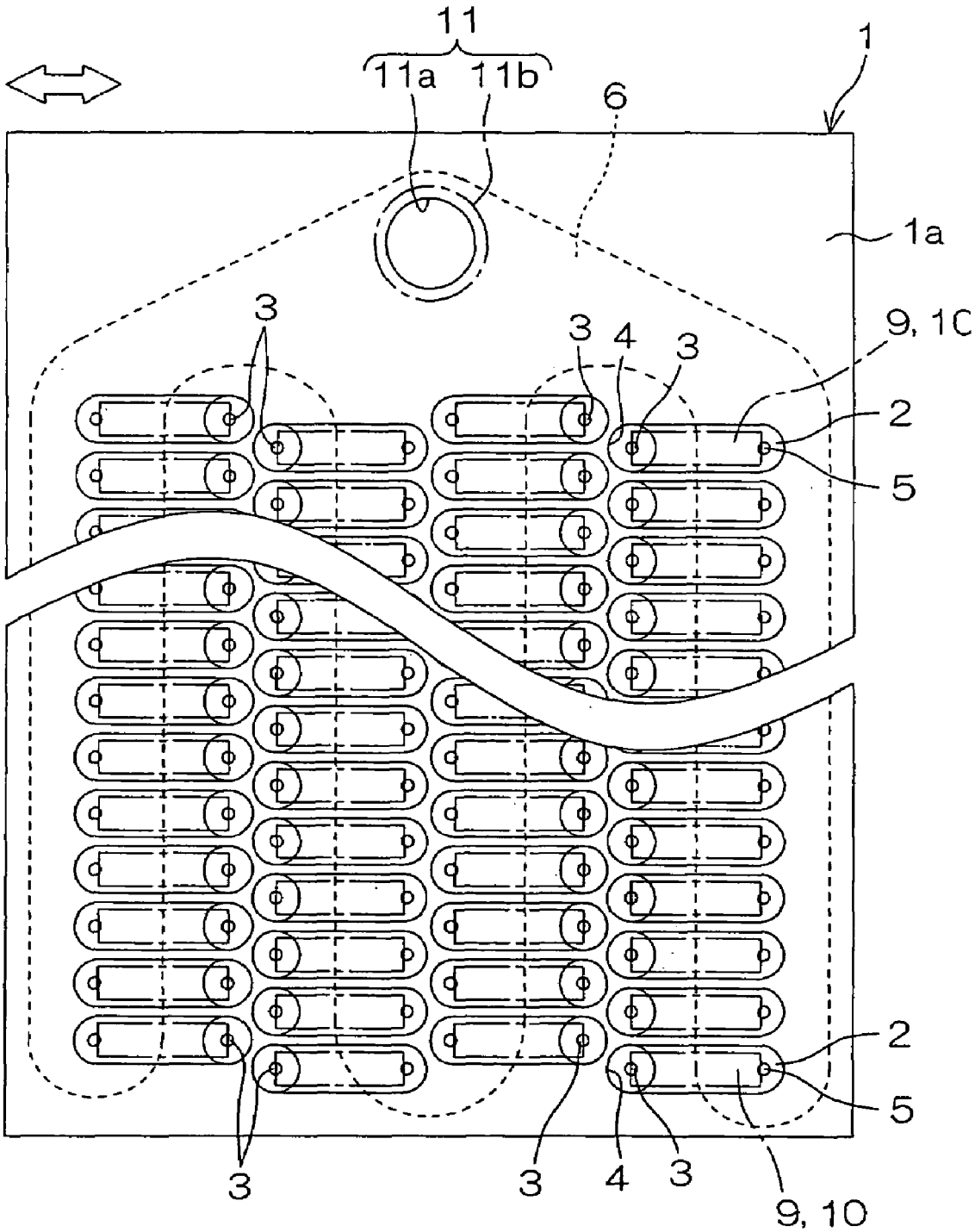
FIG. 1 is a plan view showing an example of piezoelectric ink jet head for embodying the drive method of the present invention, in a state before the drive section comprising the piezoelectric element and the oscillator plate is installed.

FIG. 1 is a plan view showing an example of piezoelectric ink jet head for embodying the drive method of the present invention, in a state before the drive section comprising the piezoelectric element and the oscillator plate is installed.

The piezoelectric ink jet head of the example shown in FIG. 1 has a plurality of dot forming sections, each comprising a pressure chamber 2 and a nozzle 3 communicating thereto, disposed on a substrate 1.

Figure 2:
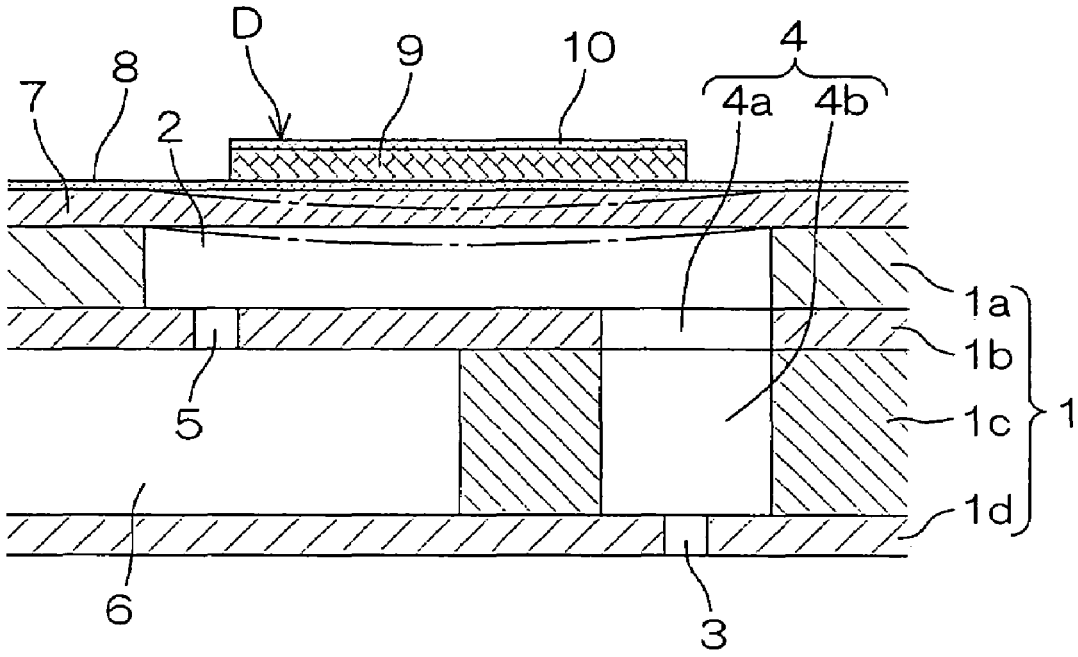
FIG. 2 is an enlarged sectional view of a dot forming section in the piezoelectric ink jet head of the example shown in FIG. 1 with the drive section installed thereon.
Figure 3:
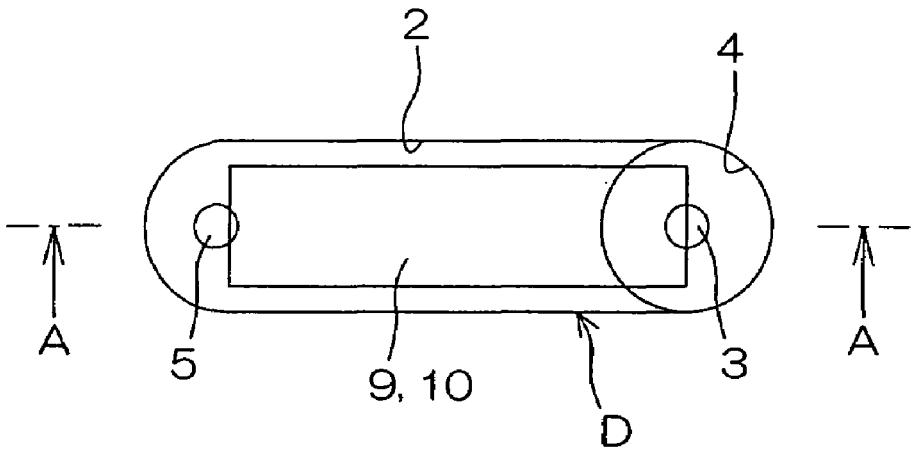
FIG. 3 is a perspective view showing the relationship between components constituting the dot forming section.

FIG. 2 is an enlarged sectional view of a dot forming section in the piezoelectric ink jet head of the example shown in FIG. 1 with the drive section installed thereon. FIG. 3 is a perspective view showing the relationship between components constituting the dot forming section being stacked one on another.

The nozzles 3 of the dot forming sections are disposed in plurality along the principal scan direction indicated by white arrow mark in FIG. 1. The dot forming sections are disposed in four rows, while the dot forming sections being arranged at pitches of 90 dpi in the same row, thus achieving a resolution of 360 dpi in the piezoelectric ink jet head as a whole.

Each of the dot forming sections comprises the pressure chamber 2 that is formed on the upper surface of the substrate 1 as shown in FIG. 2 and has a plan configuration of a rectangular mid portion with semicircular portions connected to both ends thereof (refer to FIG. 3) and a nozzle 3 formed at a position that corresponds to the center of the semicircle at one end of the pressure chamber 2 on the lower surface of the substrate 1, the pressure chamber 2 and the nozzle 3 being connected with a nozzle passage 4 that has circular cross section of the same diameter as that of the semicircle located at the end, while the pressure chamber 2 is connected to a common feed path 6 (indicated with dashed line in FIG. 1) that is formed so as to connect the dot forming sections in the substrate 1, via a feed port 5 formed at a position that corresponds to the center of the semicircle at the other end of the pressure chamber 2.

In the example shown, the components described above have such a constitution as a first substrate 1*a* whereon the pressure chamber 2 is formed, a second substrate 1*b* where on an upper portion 4*a* of the nozzle passage 4 and the feed port 5 are formed, a third substrate 1*c* having a lower portion 4*b* of the nozzle passage 4 and the common feed path 6 are formed, and a fourth substrate 1*d* whereon the nozzles 3 are formed, are stacked in this order so as to form an integral structure.

As shown in FIG. 1, the first substrate 1*a* and the second substrate 1*b* have through holes 11*a* formed therein so as to constitute a joint 11 for connecting the common feed path 6 formed on the third substrate 1*c* and the piping running from an ink cartridge which is not shown in the drawing, on the upper surface of the substrate 1.

The substrates 1*a* through 1*d* are made of a resin or a metal in plates of predetermined thickness having the through holes formed by etching method using photolithography process or the like.

The substrate 1 has, on the upper surface thereof, a drive section D constituted from an oscillator plate 7 having the same size as the substrate 1, a thin film of common electrode 8 having such a size that covers at least each dot forming section, thin plates of piezoelectric element 9 of transverse vibration mode having substantially rectangular plan configuration installed individually at positions that correspond to the centers of the pressure chambers 2 of the dot forming sections as indicated by dot and dash line in FIG. 1, and individual electrodes 10 having the same plan configuration formed on each the piezoelectric elements 9, being stacked in this order.

The piezoelectric elements 9 may also be formed in an integral body that covers the pressure chambers 2 of several dot forming sections, with only the individual electrodes 10 being formed separately at positions that correspond to the centers of the pressure chambers 2 of the dot forming sections as indicated by dot and dash line in FIG. 1.

The oscillator plate 7 is formed from a single-element metal such as molybdenum, tungsten, tantalum, titanium, platinum, ironor nickel, an alloy of such metals or other metallic material such as stainless steel in the form of a plate having a predetermined thickness. The oscillator plate 7 has a through hole 11*b* formed therein that constitutes the joint 11 together with the through hole 11*a* of the substrate 1.

The common electrode 8 and the individual electrode 10 are both formed from a foil of a metal that has high electrical conductivity such as gold, silver, platinum, copper or aluminum and a film of such a metal formed by plating, vacuum vapor deposition or the like. The common electrode 8 may be omitted by forming the oscillator plate 7 from a metal that has high electrical conductivity such as platinum.

Piezoelectric material used in forming the piezoelectric element 9 may be lead zirconate titanate (PZT), or PZT-based piezoelectric material made by adding one or more oxide of a metal such as lanthanum, barium, niobium, zinc, nickel or manganese to PZT, such as PLZT, for example, may be used. Lead magnesium niobate (PMN), lead nickel niobate (PNN), lead zinc niobate, lead manganese niobate, lead antimony stannate, lead titanate or barium titanate may be included as a major component.

The piezoelectric element 9 having thin plate shape can be formed similarly to the prior art.

For example, the piezoelectric element 9 can be formed as follows. Sintered piezoelectric material is polished into a thin plate and a chip having a predetermined plane configuration is fabricated and is bonded onto the common electrode 8 at a predetermined position thereof, a paste of an organometallic compound that makes the piezoelectric material is printed on the common electrode 8 in a predetermined pattern by a so-called sol-gel process (or MOD method), dried, calcined and fired, or a thin film of piezoelectric material is formed in a predetermined plane configuration by vapor phase growing process such as reactive sputtering, reactive vacuum vapor deposition or reactive ion plating process, thereby forming the piezoelectric element 9.

In order to operate the piezoelectric element 9 in transverse vibration mode, the piezoelectric material is controlled to polarize in the direction of thickness of the piezoelectric element 9, specifically in the direction from the individual electrode 10 toward the common electrode 8. For this purpose, known polarizing method may be employed such as high-temperature polarization, normal temperature polarization, alternate electric field superimposing or electric field cooling process. The piezoelectric element 9 may be subject to aging treatment after polarization.

The piezoelectric element 9 made of the piezoelectric material with the direction of polarization controlled as described above contracts within the plane perpendicular to the direction of polarization when a positive drive voltage $V_p$ is applied from the individual electrode 10 with the common electrode 8 being grounded. Since the piezoelectric element 9 is fixed onto the oscillator plate 7 via the common electrode 8, however, the piezoelectric element 9 and the oscillator plate 7 deflect toward the pressure chamber as indicated by dot and dash line in FIG. 2.

The deflection causes a change in pressure of the ink contained in the pressure chamber 2, and the change in pressure causes the ink to vibrate in the feed port 5, the pressure chamber 2, the nozzle passage 4 and the nozzle 3. As the velocity of vibration is directed toward the tip of the nozzle 3, ink meniscus in the nozzle 3 is pushed from the tip to the outside. Thus the column of ink mentioned previously protrudes from the tip to the outside.

While the column of ink is absorbed into the ink meniscus in the nozzle 3 as the velocity of vibration is directed toward the inside of the nozzle 3, a distal end portion of the column of ink separates so as to form an ink droplet which flies toward the paper and forms a dot on the paper.

The body of ink of which volume has decreased by the volume of the droplet that has separated therefrom is retracted by the surface tension of the ink meniscus in the nozzle 3 so as to fill the nozzle 3 again from the ink cartridge through the piping of the ink cartridge, the joint 11, the common feed path 6, the feed port 5, the pressure chamber 2 and the nozzle passage 4.

Figure 4:
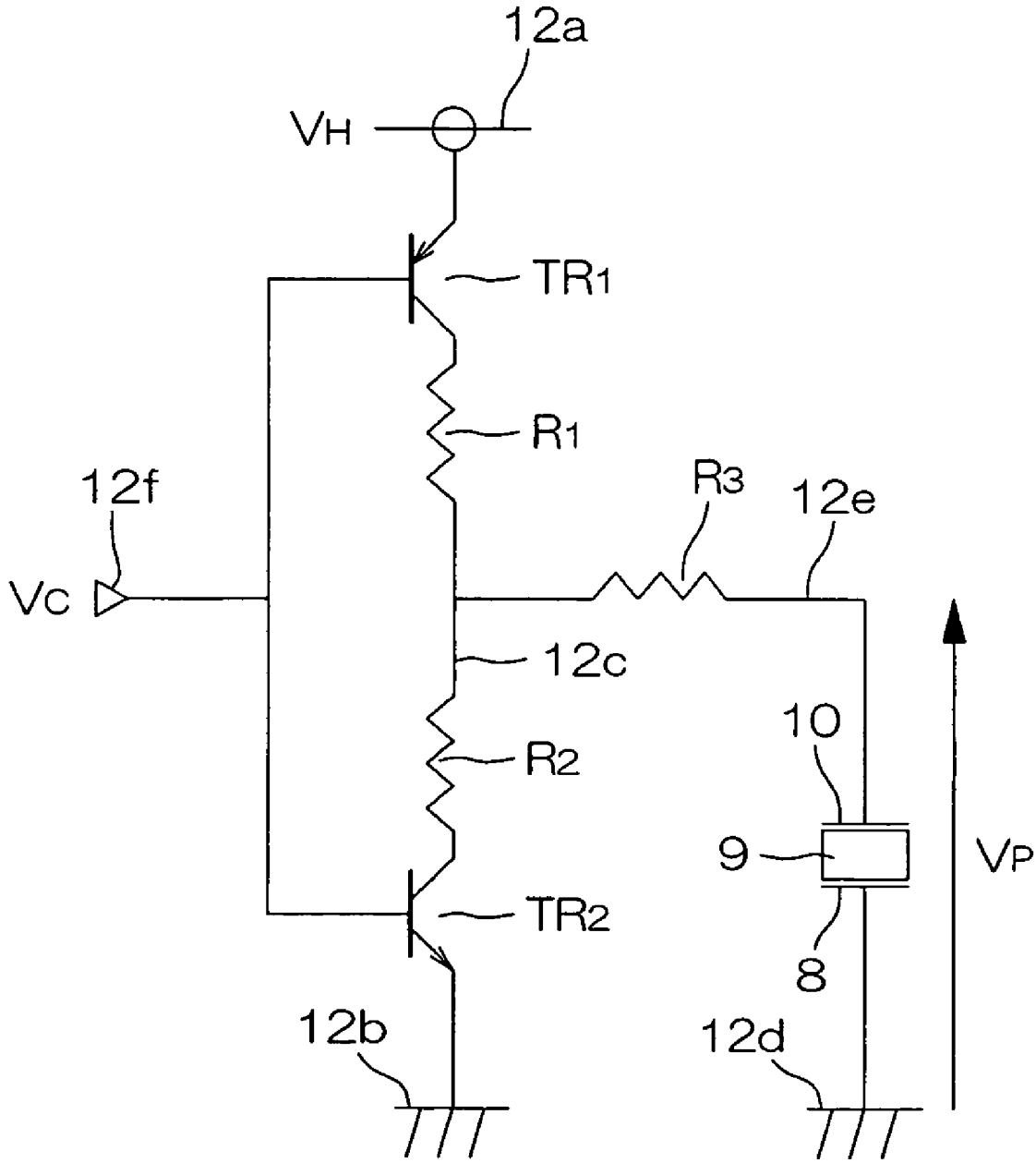
FIG. 4 is a circuit diagram showing an example of drive circuit for embodying the drive method of the present invention by driving the piezoelectric ink jet head described above.

The drive voltage waveform applied to the piezoelectric element 9 via the individual electrode 10 is generated by means of the circuit shown in FIG. 4 in this example.

The circuit shown in the drawing has such a constitution as a first transistor $TR_1$, resistors $R_1$, $R_2$ and a second transistor $TR_2$ are connected in series between a power line 12*a* and ground 12*b* thereby forming a first circuit 12*c*, while a line is branched from between the resistors $R_1$ and $R_2$ of the first circuit 12*c* so as to form a second circuit 12*e* comprising a resistors $R_3$, the individual electrode 10, the piezoelectric element 9 and the common electrode 8 leading to ground 12*d*, with terminals 12*f* connected to bases of the transistors $TR_1$, $TR_2$ for applying a control voltage $V_c$. The piezoelectric element 9 functions as an equivalent capacitor.

Figure 5:
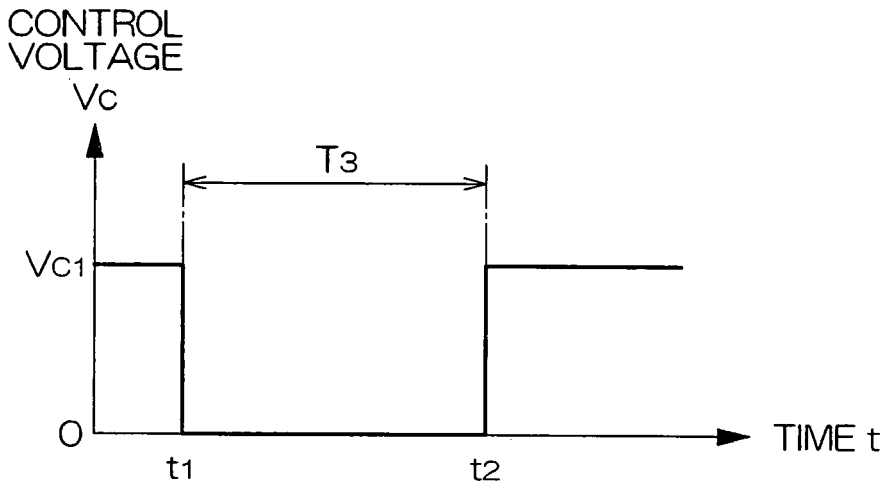
FIG. 5 is a graph showing a voltage waveform of control voltage applied to terminals of the drive circuit of FIG. 4.
Figure 6:
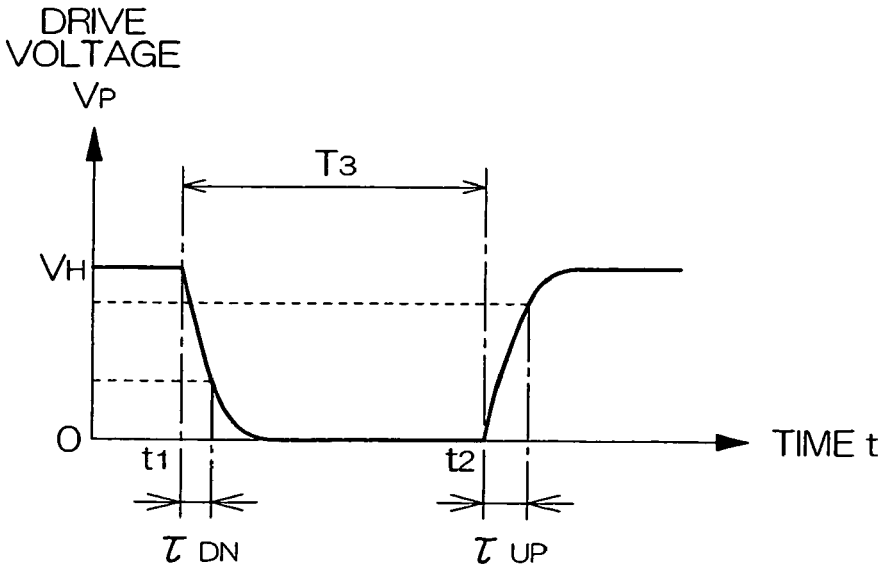
FIG. 6 is a graph showing drive voltage waveform generated by the drive circuit upon input of the control voltage and is applied to the piezoelectric element.

In case the Pull-push drive method is carried out, in the circuit described above, during standby of the piezoelectric ink jet head, namely in the period before $t_1$ (left to $t_1$) in FIG. 5, the control voltage $V_{cl}$ is applied from the terminals 12*f* to the bases of the transistors $TR_1$, and $TR_2$. In this state, since continuity is ON between emitter and collector of the first transistor $TR_1$ and is OFF between collector and emitter of the second transistor $TR_2$, the drive voltage $V_p$ that corresponds to a power voltage $V_H$ of the power line 12*a* ($V_p=V_H$) is continuously applied to the piezoelectric element 9 from the power line 12*a* via the first transistor $TR_1$, the resistors $R_1$, $R_3$ and the individual electrode 10 as shown in FIG. 6. As a result, the piezoelectric element 9 continues to contract within the plane perpendicular to the direction of polarization, so that the piezoelectric element 9 and the oscillator plate 7 keep deflected toward the pressure chamber 2.

To form a dot by the Pull-push drive method, the control voltage $V_c$ applied from the terminals 12*f* to the bases of the transistors $TR_1$, $TR_2$ is turned off at time $t_1$ immediately before forming the dot as shown in FIG. 5.

Then since continuity turns OFF between emitter and collector of the first transistor $TR_1$ and ON between collector and emitter of the second transistor $TR_2$, the drive voltage $V_p$ applied to the piezoelectric element 9 is grounded via the resistors $R_3$, $R_2$ and the second transistor $TR_2$ to the ground 12*b*.

At this time, the drive voltage $V_p$ falls from $V_H$ to 0 V ($V_p=0$), as shown in FIG. 6, following the equation (iii).

$$VP=V_H\times\exp\ [-t/\tau_{DN}] \tag{iii}$$

where t is the time lapsed since $t_1$, and $\tau_{DN}$ is the time constant of fall.

The time constant $\tau_{DN}$ of fall is given by the equation (iv) in the case of the circuit shown in FIG. 4.

$$\tau_{DN}=C_P\times(r_2+r_3) \tag{iv}$$

where $C_p$ represents equivalent capacitance of the piezoelectric element 9, and $r_2$, $r_3$ are resistance of the resistors $R_2$, $R_3$, respectively.

The above operation cancels the contraction of the piezoelectric element 9 in the direction of plane and cancels the deflection of the oscillator plate 7, so that volume of the pressure chamber 2 increases by a predetermined amount, and accordingly the ink meniscus in the nozzle 3 is pulled toward the pressure chamber 2 in proportion to the volume increase.

Figure 17:
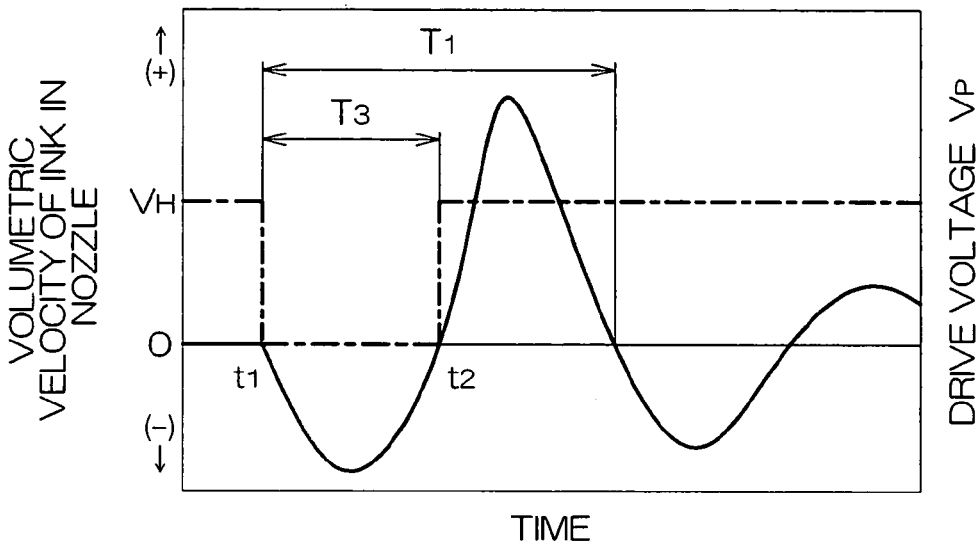
FIG. 17 is a simplified graph showing the relation between drive voltage waveform of a drive voltage $V_p$ applied to the piezoelectric element and the volumetric velocity of ink in the nozzle when the drive voltage waveform is applied with the Pull-push drive method.

Then at time $t_2$ shown in FIG. 17, the control voltage $V_{c1}$ is applied again from the terminals 12*f* to the bases of the transistors $TR_1$, $TR_2$ as shown in FIG. 5.

This causes continuity between emitter and collector of the first transistor $TR_1$ to turn ON and continuity between collector and emitter of the second transistor $TR_2$ to turn OFF, so that voltage is applied again from the power line 12*a* to the piezoelectric element 9 via the first transistor $TR_1$, the resistors $R_1$, $R_3$ and the individual electrode 10.

At this time, as shown in FIG. 6, the drive voltage $V_p$ increases again from 0 V to reach $V_H$ ($V_p=V_H$) by following the equation (v).

$$V_p=V_H\times\{1\text{-}exp\ [-t/\tau_{UP}]\} \tag{v}$$

where t is the time lapsed since $t_2$, and $\tau_{UP}$ is the time constant of rise.

The time constant $\tau_{UP}$ of rise is given by the equation (vi) in the case of the circuit shown in FIG. 4.

$$\tau_{UP}=C_p\times(r_1+r_3) \tag{vi}$$

where $C_p$ represents equivalent capacitance of the piezoelectric element 9, and $r_1$, $r_3$ are resistance of the resistors $R_1$, $R_3$, respectively.

As a result, the piezoelectric element 9 contracts in the direction of plane so that the oscillator plate 7 deflects and the volume of the pressure chamber 2 decreases, thereby squeezing the ink out of the pressure chamber 2 to the nozzle 3. This causes a pressure to be exerted by the ink that has been pushed out of the pressure chamber 2, as the ink meniscus located in the nozzle 3 that has been pulled toward the pressure chamber 2 is about to return toward the tip of the nozzle 3. As a result, the ink protrudes from the tip of the nozzle 3 so that an ink column is formed and a droplet departs from the distal end of the ink column, flies and forms a dot on the paper.

To implement the Push-pull drive method, control voltage $V_c$ having a phase opposite to that described above is applied to the terminals 12*f* of the circuit shown in FIG. 4. During standby of the piezoelectric ink jet head before the time $t_1$ (left to $t_1$) in FIG. 7, such a state that the control voltage $V_c$ is not applied to the terminals 12*f* is maintained. In this state, since continuity is OFF between emitter and collector of the first transistor $TR_1$ and is ON between collector and emitter of the second transistor $TR_2$, the circuit from the power source 12*a* via the first transistor $TR_1$, the resistors $R_1$, $R_3$ and the individual electrode 10 to the piezoelectric element 9 is kept shut off. At the same time, since the circuit from the piezoelectric element 9 via the resistors $R_3$, $R_2$ and the second transistor $TR_2$ to the ground 12*b* is kept connected, the state of the piezoelectric element 9 without the drive voltage applied thereto is maintained.

In order to form a dot by the Push-pull drive method, the control voltage $V_c$ is applied to the terminals 12*f* at time $t_1$ immediately before forming the dot described previously.

Then since continuity turns ON between emitter and collector of the first transistor $TR_1$ and OFF between collector and emitter of the second transistor $TR_2$, voltage is applied from the power line 12*a* via the first transistor $TR_1$, the resistors $R_1$, $R_3$ and the individual electrode 10 to the piezoelectric element 9.

Figure 7:
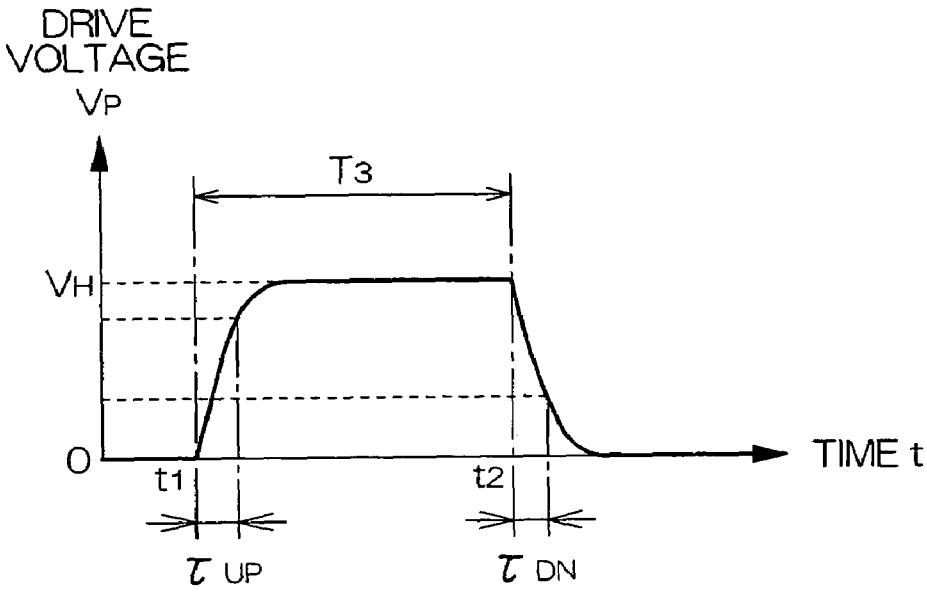
FIG. 7 is a graph showing another example of a drive voltage waveform.

At this time, the drive voltage $V_p$ rises from 0 V as shown in FIG. 7 and reaches $V_H$ ($V_p=V_H$) following the equation (v). Time constant $\tau_{UP}$ of rise is given by the equation (vi) described above.

The above operation causes the piezoelectric element 9 to contract in the direction of plane and the oscillator plate 7 to deflect, so that volume of the pressure chamber 2 decreases, and accordingly the ink is pushed out of the pressure chamber 2 into the nozzle 3, and then the ink column is formed by the intrinsic vibration of the ink as described previously.

Figure 18:
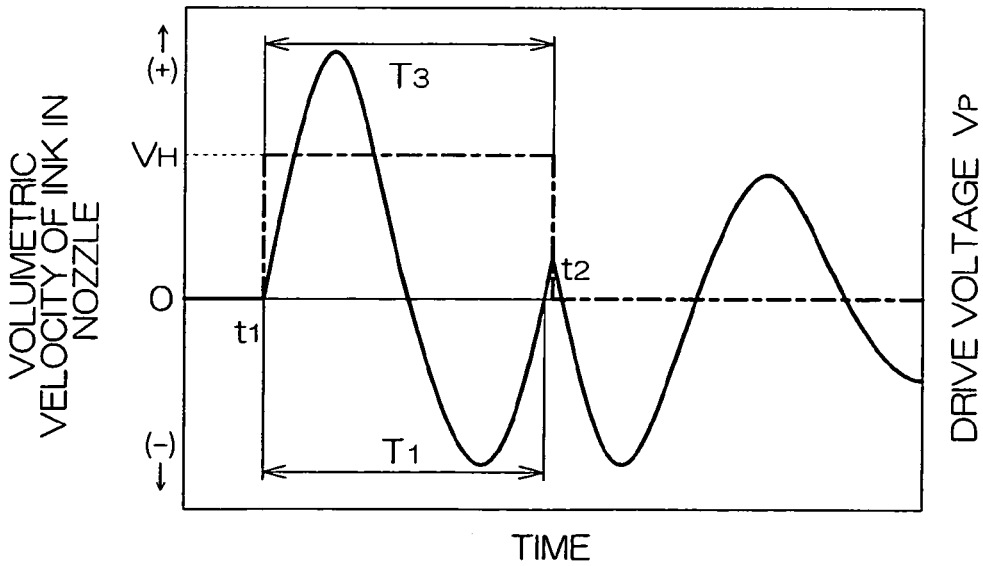
FIG. 18 is a simplified graph showing the relation between drive voltage waveform of drive voltage $V_p$ applied to the piezoelectric element and the volumetric velocity of ink in the nozzle when the drive voltage waveform is applied with the Push-pull drive method.
Figure 19:
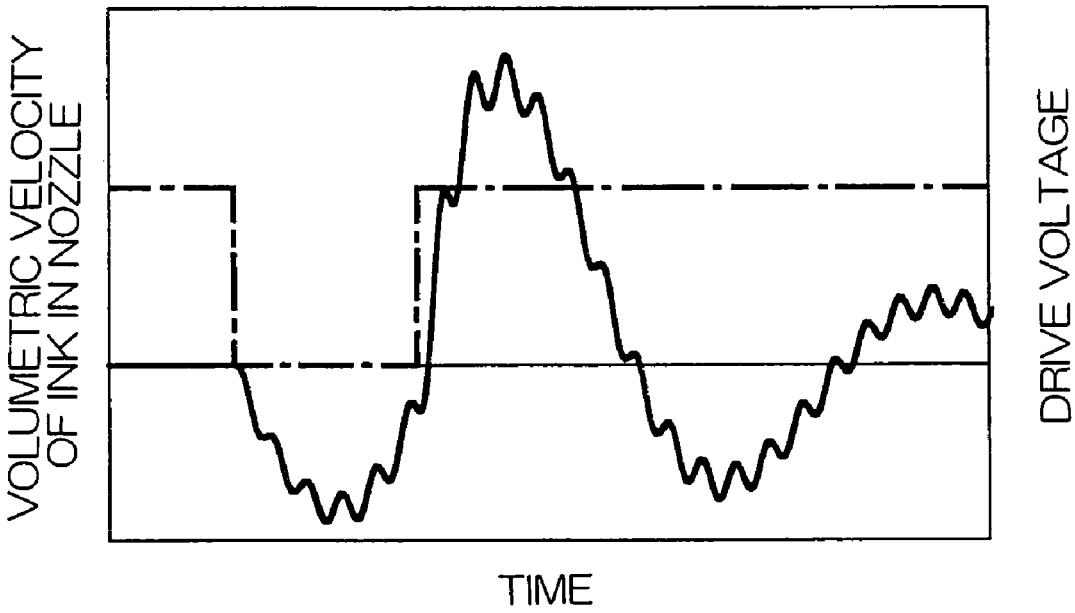
FIG. 19 is a graph showing the effect of ensuing natural period of vibration superposed on the vibration of the volumetric velocity of ink in the nozzle in the case of the piezoelectric ink jet head.

Then at time $t_2$ in FIG. 18, the control voltage $V_c$ applied from the terminals 12*f* to the bases of the transistors $TR_1$, $TR_2$ is shut down.

This causes continuity between emitter and collector of the first transistor $TR_1$ to turn OFF and continuity between collector and emitter of the second transistor $TR_2$ to turn ON, so that the drive voltage $V_p$ that has been applied to the piezoelectric element 9 is grounded via the resistors $R_3$, $R_2$ and the first transistor $TR_2$ to the ground 12*b*.

At this time, the drive voltage $V_p$ falls from $V_H$ as shown in FIG. 7 following the equation (iii) and eventually reaches 0 V ($V_p$=0). Time constant $\tau_{DN}$ of fall is given by the equation (iv) described above.

The above operation cancels the contraction of the piezoelectric element 9 in the direction of plane and cancels the deflection of the oscillator plate 7, so that volume of the pressure chamber 2 increases by a predetermined amount, and accordingly the ink meniscus in the nozzle 3 is pulled toward the pressure chamber 2 in proportion to the volume increase. Thus the ink column is separated and an ink droplet is formed. As the ink droplet reaches the paper surface, a dot is formed on the paper.

In the invention according to claim 1, it is necessary to set the time required for the drive voltage $V_p$ that is applied to the piezoelectric element 9 to fall to 1–25% of $V_H$ during fall of the drive voltage waveform, namely the period of time before the relation of the expression (vii):

$$V_H \times 0.01 \leqq V_p \leqq V_H \times 0.25 \quad \text{(vii)}$$

is satisfied, equal to the period Ta of the ensuing vibration of the drive section which is superposed on the vibration wave form of the volumetric velocity of ink in the head, or set the time required for the drive voltage $V_p$ that is applied to the piezoelectric element 9 to rise to 75–99% of $V_H$ during rise of the drive voltage waveform, namely the period of time before the relation of the expression (viii):

$$V_H \times 0.75 \leqq V_p \leqq V_H \times 0.99 \quad \text{(viii)}$$

is satisfied, also equal to the period Ta, or both of these settings are made at the same time.

That is, time constant $\tau_{UP}$ of rise of the drive voltage $V_p$ is set in a range that satisfies the relation of the expression (i):

$$Ta/(-\ln 0.01) \leqq \tau_{UP} \leqq Ta/(-\ln 0.25) \quad \text{(i)}$$

with respect to the period Ta of the ensuing vibration of the drive section that is superposed on the vibration waveform of the volumetric velocity of ink in the head, or time constant $\tau_{DN}$ of fall of the drive voltage $V_p$ is set in a range that satisfies the relation of the expression (ii):

$$Ta/(-\ln 0.01) \leqq \tau_{DN} \leqq Ta/(-\ln 0.25) \quad \text{(ii)}$$

with respect to the period Ta.

Or, alternatively, both of these settings are made at the same time. This makes it possible to suppress the ensuing vibration of the drive section D while suppressing the flying speed of the ink droplet from decreasing.

For this purpose, as will be clear from the equations (iv) and (vi), the equivalent capacitance $C_p$ of the piezoelectric element 9 and resistance $r_1$ through $r_3$ of the resistors $R_1$ through $R_3$, of the circuit shown in FIG. 4 may be set to values that satisfy the relations of the expressions (i) and (ii).

In order to further improve the effect of suppressing the ensuing vibration of the drive section, it is preferable that time constant $\tau_{UP}$ of rise of drive voltage $V_p$ is especially in a range defined by the relation of the expression (i-1):

$$Ta/(-\ln 0.05) \leqq \tau_{UP} \leqq Ta/(-\ln 0.25) \quad \text{(i-1)}$$

within the range described above.

For the same reason, time constant $\tau_{DN}$ of fall is preferably in the range defined by the relation of the expression (ii-1).

$$Ta/(-\ln 0.05) - \tau_{DN} \leqq Ta/(-\ln 0.25) \quad \text{(ii-1)}$$

As described previously, pulse width $T_3$ of the drive voltage waveform between the rise and the fall of the drive voltage is set at an integral multiple of the period Ta of the ensuing vibration of the drive section that is superposed on the vibration waveform of the volumetric velocity of ink in the head. This makes it possible to surely suppress the ensuing vibration of the drive section D while suppressing the decrease in the flying speed of ink droplet.

That is, in the Pull-push drive method, when the drive voltage waveform rises at a time when the ensuing vibration of the drive section D caused by the fall of the drive voltage waveform has completed an even number of half periods, namely an integral multiple of the period, a vibration having phase opposite to that of the ensuing vibration is generated in the drive voltage waveform, so that the two vibrations cancel each other, thereby suppressing the subsequent ensuing vibration of the drive section D.

When the drive voltage waveform rises at a time when the ensuing vibration of the drive section D has completed an odd number of half periods, however, a vibration having the same phase as that of the ensuing vibration is generated in the drive voltage waveform, so that the two vibrations enhance each other, thereby increasing the subsequent ensuing vibration of the drive section D.

Therefore, in order to suppress the ensuing vibration of the drive section D that is superposed on the vibration of natural frequency of the volumetric velocity of ink in the head, pulse width $T_3$ that defines the timing of he drive voltage waveform to rise may be set at an even number of half of the period Ta, namely an integral multiple of the period of the ensuing vibration.

When the mechanism of discharging the ink droplet in the Pull-push drive method is taken into consideration, it is necessary to set the pulse width $T_3$ of the drive voltage waveform on the basis of one half of the natural period of vibration $T_1$ of the volumetric velocity of ink in the head. Accordingly, it is preferable to set the pulse width $T_3$ of the drive voltage waveform at a value that is nearest to one half of the natural period of vibration $T_1$ of volumetric velocity of ink and is an integral multiple of the period Ta of the ensuing vibration of the drive section D.

In the Push-pull drive method, if the drive voltage waveform is controlled to fall when the ensuing vibration of the drive section D, that is caused by increasing the drive voltage waveform in rising phase, has completed an even number of half periods, namely an integral multiple of the period, a vibration having a phase opposite to that of the ensuing vibration is generated in the drive section D, so that the two vibrations cancel each other, thereby suppressing the subsequent ensuing vibration of the drive section D.

If the drive voltage waveform is controlled to fall at a time when the ensuing vibration of the drive section D has completed an odd number of half periods, however, a vibration having the same phase as that of the ensuing vibration is generated in the drive section D, so that the two vibrations enhance each other, thereby further increasing the subsequent ensuing vibration of the drive section D.

Therefore, in order to suppress the ensuing vibration of the drive section D that is superposed on the intrinsic vibration of the volumetric velocity of ink in the head, pulse width $T_3$ that defines the timing of the drive voltage waveform to fall may be set at an even number of half of the period Ta, namely at an integral multiple of the period of the ensuing vibration.

When the mechanism of discharging the ink droplet in the Push-pull drive method is taken into consideration, it is necessary to set the pulse width $T_3$ of the drive voltage waveform on the basis of one period $T_1$ of the intrinsic vibration of the volumetric velocity of ink in the head. Accordingly, it is preferable to set the pulse width $T_3$ of the drive voltage waveform at a value that is nearest to one period $T_1$ of the intrinsic vibration of the volumetric velocity of ink and is an integral multiple of the period Ta of the ensuing vibration of the drive section D.

The constitutions of the invention can also be embodied simultaneously. That is, by setting the time constants of rise and/or fall of the drive voltage in the ranges defined by the relations of expressions (i) and (ii) and setting the pulse width $T_3$ of the drive voltage waveform from the rise to fall of the drive voltage at an integral multiple of the period Ta of the ensuing vibration of the drive section D, the effect of suppressing the ensuing vibration of the drive section D can be further improved while suppressing the decrease in the flying speed of ink droplet.

Figure 8:
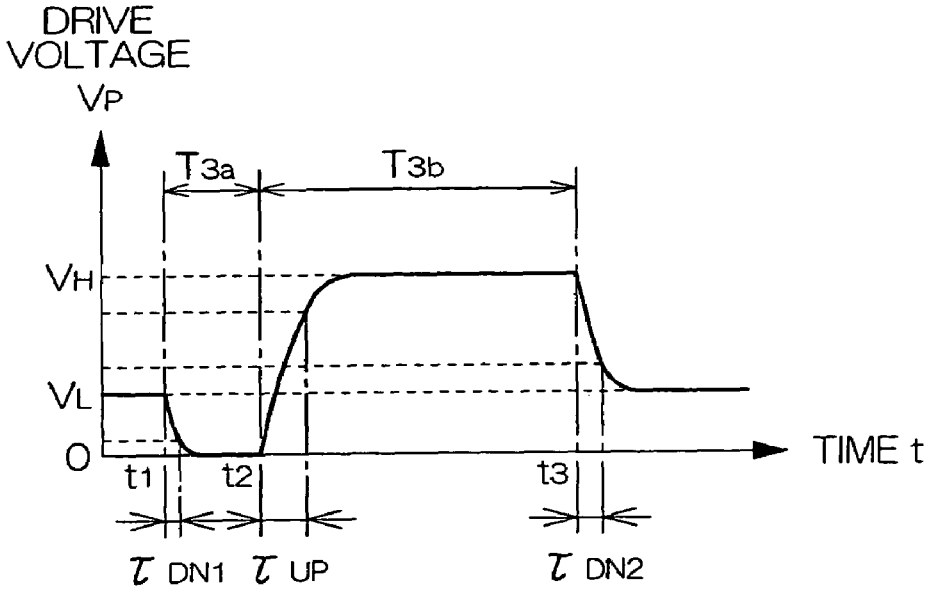
FIG. 8 is a graph showing still another example of a drive voltage waveform.

The invention of can also be applied to a drive method shown in FIG. 8 that combines Pull-push drive method and Push-pull drive method.

With this drive method, in the state of standby, a voltage $V_L$ that is lower than the voltage $V_H$ which is applied when forming a dot is continuously applied as the drive voltage $V_p$ to the piezoelectric element 9, and accordingly the piezoelectric element 9 and the oscillator plate 7 maintain a state of being deflected more mildly than they are when forming a dot.

When forming a dot, the drive voltage $V_p$ applied to the piezoelectric element is removed ($V_p$=0) at time $t_1$ immediately before forming the dot so as to cancel the deflection of the oscillator plate 7, there by pulling the ink meniscus in the nozzle toward the pressure chamber. Then at time $t_2$, the drive voltage $V_p$ having the value of $V_H$ is applied ($V_p$=$V_H$) to the piezoelectric element to cause the oscillator plate to deflect more heavily than it does during standby, so as to push the ink meniscus toward the outside of the nozzle and form an ink column. At time $t_3$, as the drive voltage $V_p$ is decreased from $V_H$ to $V_L$, so as to cause the oscillator plate to return from the state of heavily deflected to the state of mildly deflected during standby, thereby to suppress the vibration of the meniscus, then the ink column is separated an ink droplet is formed. As the ink droplet thus formed reaches the paper, a dot is formed on the paper.

In the drive method described above, it is made possible to surely suppress the ensuing vibration of the drive section D while suppressing the flying speed of the ink droplet from decreasing, by setting the time constant $\tau_{DN1}$ of fall of the drive voltage $V_p$ at time $t_1$ in a range that satisfies the relation (ii), setting the time constant $\tau_{UP}$ of rise of the drive voltage $V_p$ at time $t_2$ in the range that satisfies the relation (i), or setting the time constant $\tau_{DN\,2}$ of fall of the drive voltage $V_p$ at time $t_3$ in a range that satisfies the relation (ii), or employing at least two of these settings.

It is also made possible to surely suppress the ensuing vibration of the drive section D while suppressing the flying speed of the ink droplet from decreasing, by setting at least one of the pulse width $T_{3a}$ of the drive voltage waveform from the fall of the drive voltage $V_p$ at $t_1$ to the rise of the drive voltage $V_p$ at $t_2$ and the pulse width $T_{3b}$ of the drive voltage waveform from the rise of the drive voltage $V_p$ at $t_2$ to the fall of the drive voltage $V_p$ at $t_3$ at an integral multiple of the period Ta of the ensuing vibration of the drive section.

The period Ta of the ensuing vibration of the drive section D mentioned in the inventions is the period of vibration when the head is filled with ink, determined as follows.

The drive section D has a natural angular frequency $\omega a_0$ of vibration that is determined only by the elasticity and inertia of the section, when there is no ink in the head. The natural angular frequency $\omega a_0$ of vibration is determined from restoring force 1/Ca that is the inverse of acoustical capacitance of the drive section D and inertance Ma by the equation (1).

$$\omega a_o^2=(1/Ca)/Ma \tag{1}$$

Based on this calculation, natural period of vibration $Ta_0$ of the drive section D when the head is not filled with the ink is determined by the equation (2).

$$Ta_0=2\pi\sqrt{Ma\times Ca} \tag{2}$$

In practice, the natural period of vibration $Ta_0$ can be derived from the result of measuring the impedance of the head which is not filled with ink by connecting an impedance analyzer to the individual electrode 10 and the common electrode 8 and sweeping the frequencies. Angular frequency when the impedance shows the minimum value is the natural angular frequency $\omega a_0$ and the period at this time is the natural period of vibration $Ta_0$.

However, actual period Ta of the ensuing vibration of the drive section that is superposed over the vibration waveform of the volumetric velocity of the ink in the head is smaller than the natural period of vibration $Ta_0$. This is because the compressivity 1/Cc of the ink in the pressure chamber that is the inverse of acoustical capacitance of the pressure chamber 2, along with the elasticity of the drive section D, adds up to the restoring force of the drive section D.

Thus the angular frequency $\omega a$ of the ensuing vibration of the drive section D when there is ink filled in the head is determined by the equation (3).

$$\omega a^2=(1/Ca+1/Cc)/Ma \tag{3}$$

Based on this calculation, period Ta of the ensuing vibration of the drive section D that is superposed on the vibration waveform of the volumetric velocity of ink in the head when the head is filled with the ink is determined by the equation (4).

$$Ta=2\pi\sqrt{Ma\times Ca\times Cc/(Ca+Cc)} \tag{4}$$

In practice, the period Ta of the ensuing vibration can be derived from the result of measuring the impedance of the head filled with ink by using an impedance analyzer similarly as described above. Angular frequency when the impedance shows the minimum value is the angular frequency $\omega a$ and the period at this time is the Ta of the ensuing vibration.

Also because the period Ta of the ensuing vibration and the natural period of vibration $Ta_0$ satisfy the equation (5):

$$Ta=Ta_0/\sqrt{1+Ca/Cc} \tag{5}$$

derived from the equations (2) and (4).

Ta can be calculated by this equation, provided that the natural period of vibration $Ta_0$ is known from the measurement described above.

At this time, acoustical capacitance Ca [$m^5$/N] of the drive section is given by the equation (6):

$$Ca=\delta V/P \quad (6)$$

where P is the pressure [N/$m^2$] applied to the drive section and δV is a change in volume [$m^3$] of the drive section.

Acoustical capacitance Cc [$m^5$/N] of the pressure chamber 2 is given by the equation (7):

$$Cc=V/\kappa \quad (7)$$

where V is the volume [$m^3$] of the pressure chamber 2 and κ is the bulk modulus [N/$m^2$] of the ink.

EXAMPLE

Example 1

Fabrication of Piezoelectric Ink Jet Head

A piezoelectric ink jet head having the structure shown FIG. 1 through FIG. 3 was fabricated with the pressure chamber 2 having area of 0.2 mm2 and measuring 200 μm in width and 100 μm in depth, the nozzle 3 measuring 25 μm in diameter and 30 μm in length, the nozzle passage 4 measuring 200 μm in diameter and800 μm in length, the feed port 5 measuring 25 μm in diameter and 30μm in length, an oscillator plate 7 measuring 50 μm in thickness, and a piezoelectric element 9 measuring 20 μm in thickness.

Natural period of vibration $Ta_0$ of the drive section D measured by the method using the impedance analyzer described above was 0.859 μm sec. Acoustical capacitance Ca of the drive section D was $20\times10^{-21}$ [$m^5$/N] and acoustical capacitance Cc of the pressure chamber 2 was $23\times10^{-21}$ [$m^5$/N]. The period Ta of the ensuing vibration of the drive section that is superposed on the vibration waveform of the volumetric velocity of ink in the head calculated from these values by the equation (v) was 0.628 μsec.

The common electrode 8 and the individual electrode 10 of the drive section were connected to the drive circuit shown in FIG. 4.

Fabrication of Equivalent Electrical Circuit

Figure 9:
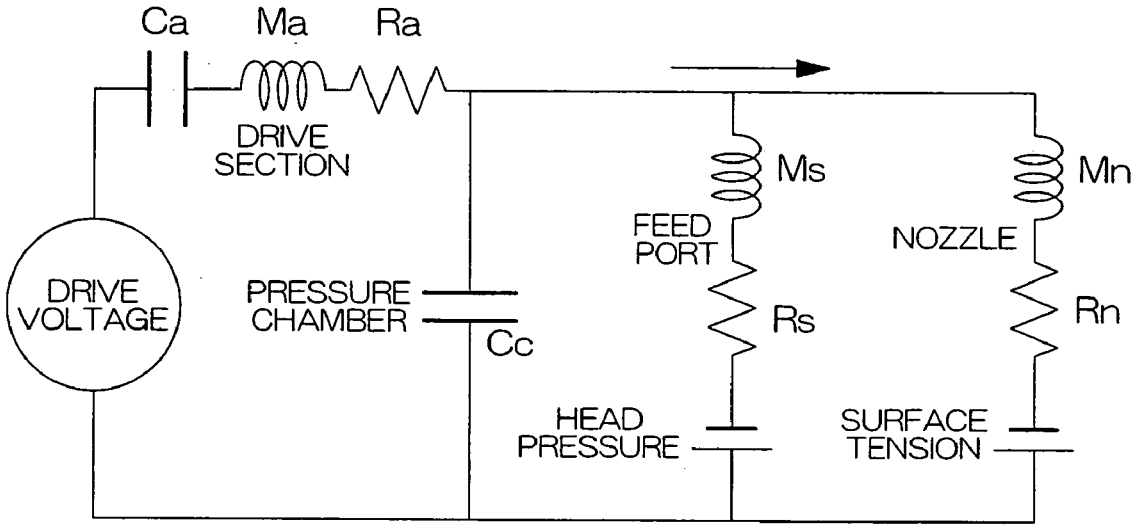
FIG. 9 is a circuit diagram showing an equivalent electrical circuit formed by representing the components of the piezoelectric ink jet head, fabricated in an example of the present invention, with lumped constants.

Equivalent electrical circuit of the acoustical system shown in FIG. 9 was made by representing the components of the piezoelectric ink jet head with lumped constant.

In the equivalent electrical circuit shown in the drawing, the drive section can be equivalently represented by acoustical capacitance Ca, inertance Ma and acoustical resistance Ra, and the pressure chamber 2 can be represented by acoustical capacitance Cc.

While the feed port 5 can be equivalently represented by inertance Ms and acoustical resistance Rs, it is under head pressure corresponding to the difference in height between the ink meniscus of the nozzle 3 and the surface of the ink in the ink cartridge not shown.

The nozzle 3 can also be equivalently represented by inertance Mn and acoustical resistance Rn, and is subject to surface tension of the ink meniscus of the nozzle 3 acting thereon.

In the equivalent electrical circuit described above, when the drive voltage $V_p$ is applied to the drive section so as to generate a pressure, flow of ink is generated in the direction indicated by an arrow in the drawing, in the nozzle 3, of which volumetric velocity can be determined. The flying speed of ink droplet can be calculated from the volumetric velocity that has been determined, diameter of the nozzle 3 and the surface tension of the ink.

Calculation of Flying Speed of Ink Droplet

The piezoelectric ink jet head fabricated in the example was driven by the Pull-push method with the drive voltage $V_p$ having the drive voltage waveform shown in FIG. 6.

Resistance $r_1$ through $r_3$ of the resistors $R_1$ through $R_3$ of the drive circuit shown in FIG. 4 were changed (with relationship $r_1=r_2$ being maintained) so that the drive voltage waveform has such values of time constant $\tau_{UP}$ of rise and time constant $\tau_{DN}$ of fall ($\tau_{UP}=\tau_{DN}$) as the time required for the drive voltage $V_p$ applied to the piezoelectric element to fall to x % of $V_H$ and the time required for the drive voltage $V_p$ applied to the piezoelectric element to rise to (100-x)% of $V_H$ both become equal to the period Ta of the ensuing vibration of the drive section which is superposed on the vibration waveform of the volumetric velocity of ink in the head.

Calculation of the flying speed of ink droplet with the equivalent electrical circuit using the drive voltage waveform having the time constants $\tau_{UP}$ and $\tau_{DN}$ that were set as described above resulted in values shown in Table 1.

TABLE 1

| x [%] | $\tau_{UP}=\tau_{DN}$ [μ sec] | Flying speed of ink droplet [m/s] |
|---|---|---|
| 0.1 | 0.091 | 11.1 |
| 1 | 0.136 | 11.1 |
| 5 | 0.210 | 11.0 |
| 10 | 0.273 | 11.0 |
| 20 | 0.390 | 10.7 |
| 25 | 0.453 | 9.8 |
| 30 | 0.522 | 9.6 |

The result shows that the decrease in the flying speed of ink droplet can be restricted to about 10% of that in the case of driving with drive voltage waveform having time constants $\tau_{UP}$ and $\tau_{DN}$ both near zero, by setting the time constants $\tau_{UP}$ and $\tau_{DN}$ both within 0.453 μsec, namely when x is 25% or less. Investigation of ensuing vibration of the drive section The piezoelectric ink jet head fabricated in the example was driven by the Pull-push method with the drive voltage $V_p$ having the drive voltage waveform shown in FIG. 6.

Figure 10:
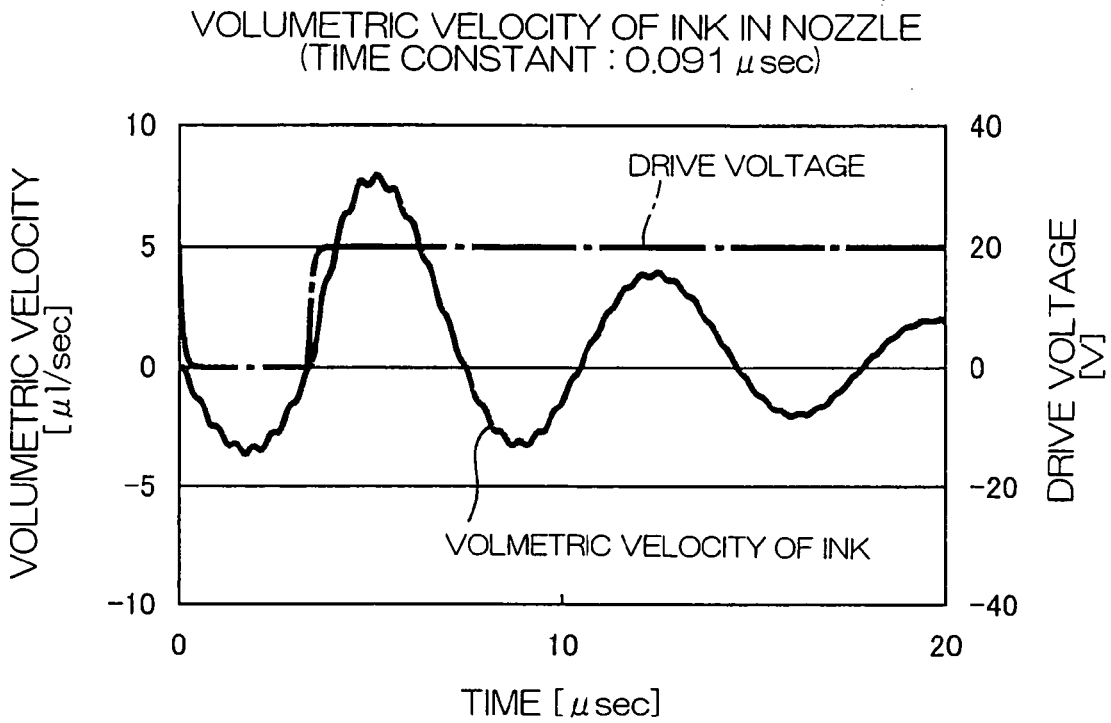
FIG. 10 through FIG. 12 are graphs showing the results of simulations for the vibration of volumetric velocity of ink when a drive voltage waveform, having constants of rise and fall time being set at predetermined values, is applied to the piezoelectric ink jet head that was fabricated in an example of the present invention.
Figure 11:
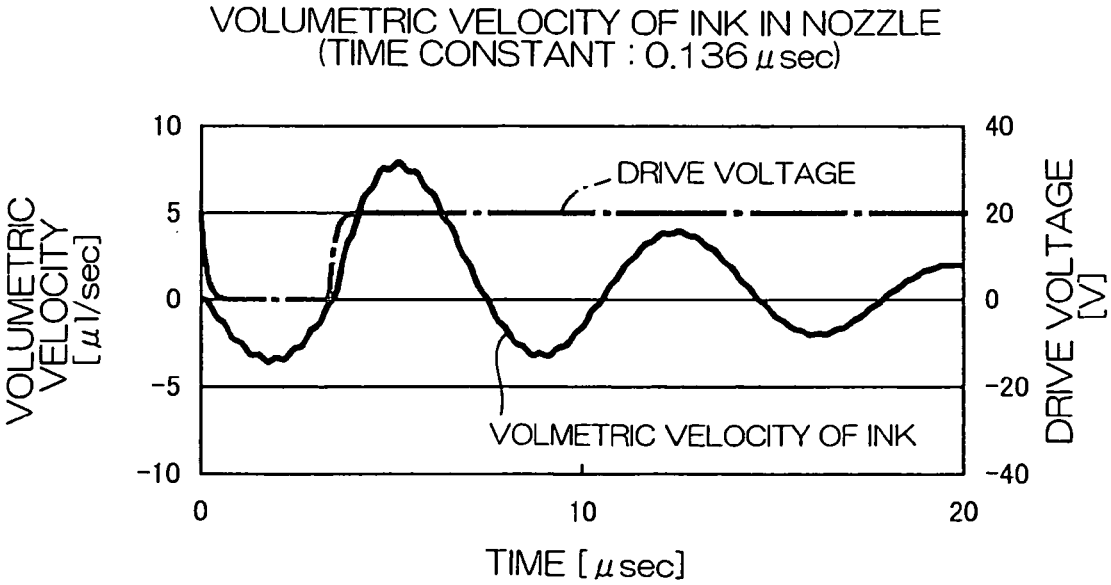
Figure 12:
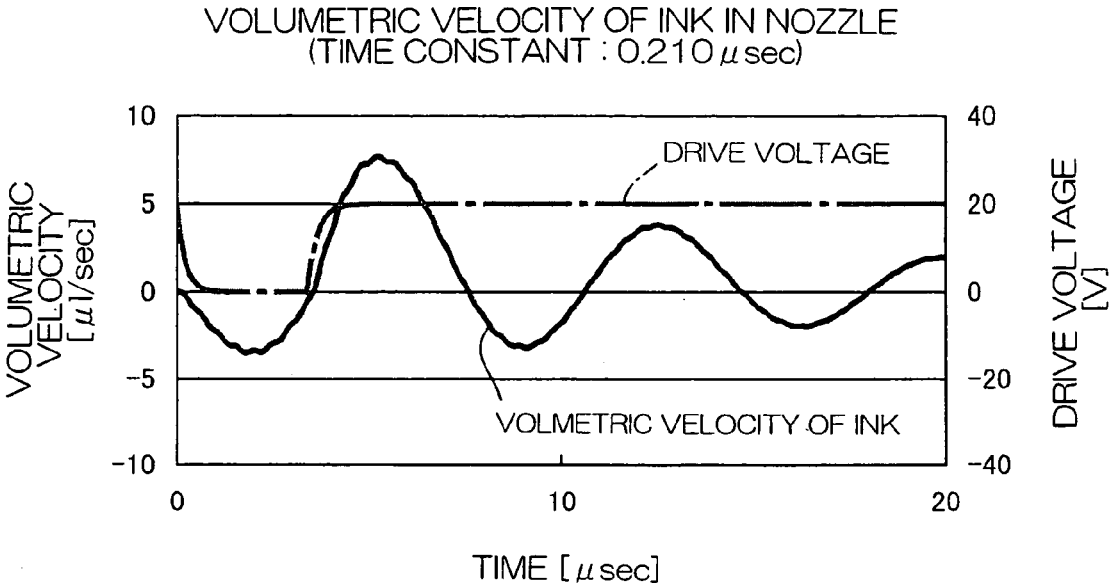

Then vibration of volumetric velocity of ink was simulated in cases where time constants τup and $\tau_{DN}$ of drive voltage waveform were both 0.210 μsec (x =5%), 0.136 μsec (x =1%) and 0.091 μsec (x =0.1%), and the results shown in FIG. 10 through FIG. 12 were obtained.

From these results, it was found that the influence of the ensuing vibration of the drive section is evident in the vibration of volumetric velocity when the time constant is 0.091 μsec as shown in FIG. 10, although the ensuing vibration of the drive section can be suppressed when the time constant is 0.136 μsec or more as shown in FIG. 11 and FIG. 12.

Conslusion

It was found that the time constant must be 0.136 μsec or more and not more than 0.453 μsec, in order to suppress the ensuing vibration of the drive section and restrict the decrease in the flying speed of ink droplet.

The above finding shows that such a constitution is satisfactory as the time required for the voltage applied to the piezoelectric element to fall to 1–25% is set equal to the natural period of vibration of the drive section during fall of the drive voltage waveform, and the time required for the voltage applied to the piezoelectric element to rise to 75–99% is set equal to the natural period of vibration of the drive section during rise of the drive voltage waveform.

Example 2

A piezoelectric ink jet head having the structure shown FIG. 1 through FIG. 3 was fabricated with the pressure chamber 2 having area of 0.2 $mm^2$ and measuring 200 μm in width and 100 μm in depth, the nozzle 3 measuring 25 μm in diameter and 30 μm in length, the nozzle passage 4 measuring 200 μm in diameter and 800 μm in length, the feed port 5 measuring 25 μm in diameter and 30 μm in length, an oscillator plate 7 measuring 30 μm in thickness, and a piezoelectric element 9 measuring 20 μm in thickness.

Natural period of vibration $Ta_0$ of the drive section D measured by the method using the impedance analyzer described above was 1.26 μsec. Acoustical capacitance Ca of the drive section D was $20\times10^{-21}$ [$m^5$/N] and acoustical capacitance Cc of the pressure chamber 2 was $23\times10^{-21}$ [$m^5$/N]. The period Ta of the ensuing vibration of the drive section that is superposed on the vibration waveform of the volumetric velocity of ink in the head calculated from these values by the equation (v) was 0.92 μsec.

The common electrode 8 and the individual electrode 10 of the drive section were connected to the drive circuit shown in FIG. 4.

Observation of Print Quality

The piezoelectric ink jet head fabricated in the example was driven by the Pull-push method with the drive voltage $V_p$ having the drive voltage waveform shown in FIG. 6, the predetermined value $V_H$ of the drive voltage $V_p$ being 20 V and the pulse width $T_3$ being changed by increment of 0.46 μsec from 3.22 μsec to 4.60 μsec (from 3.5 times to 5 times the period Ta), and the quality of print on paper was evaluated.

The results are shown in Table 2. Quality of print was evaluated as follows.

TABLE 2

| Pulse width $T_3$ [μ sec] | $T_3$/Ta | Picture quality |
|---|---|---|
| 3.22 | 3.5 | X |
| 3.68 | 4 | ○ |
| 4.14 | 4.5 | X |
| 4.60 | 5 | ○ |

○: Good printing without dust
X: Printing with dust

It was found from the results shown in Table, that the print included dust when the pulse width $T_3$ was set at an odd number of half of the period Ta of the ensuing vibration of the drive section superposed on the vibration waveform of the volumetric velocity of ink in the head, although good print without dust could be obtained when the pulse width $T_3$ was set at an even number of half periods, namely an integral multiple of the period Ta.

Fabrication of Equivalent Electrical Circuit

Equivalent electrical circuit of the acoustical system shown in FIG. 9 was made for the piezoelectric ink jet head described above similarly as described previously. Investigation of ensuing vibration of the drive section Then vibration of the volumetric velocity of ink was simulated by driving the piezoelectric ink jet head fabricated in the example with the drive voltage $V_p$ having the drive voltage waveform shown in FIG. 6 similarly to that described above, the predetermined value $V_H$ of the drive voltage $V_p$ being 20 V and the pulse width $T_3$ being changed by increment of 0.46 μsec from 3.22 μsec to4.60 μsec, with the results shown in FIG. 13 through FIG. 16.

Figure 13:
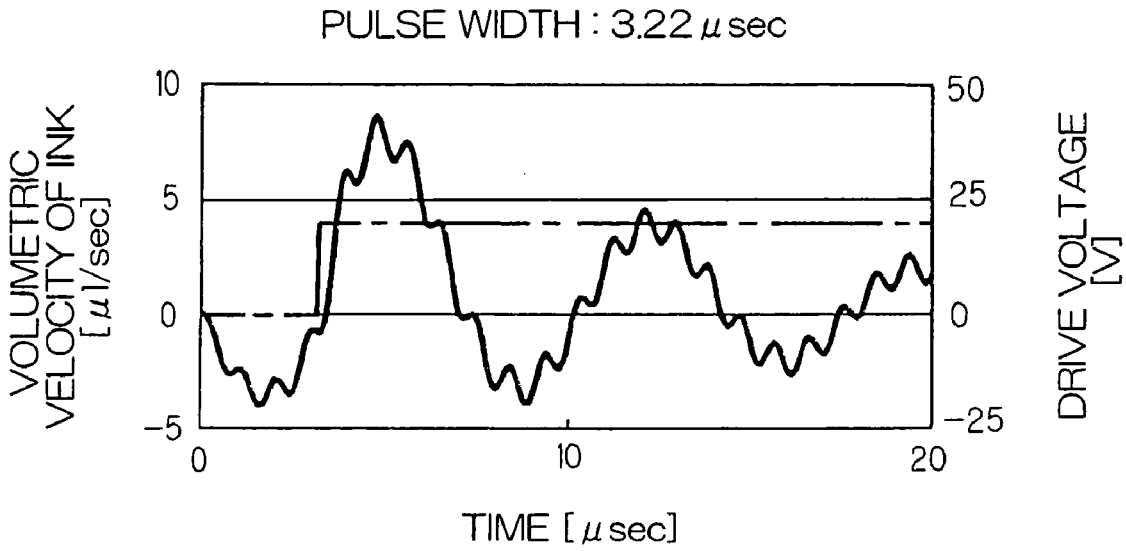
FIG. 13 through FIG. 16 are graphs showing the results of simulations for the vibration of volumetric velocity of ink when a drive voltage waveform, having pulse width being set at a predetermined value, is applied to the piezoelectric ink jet head that was fabricated in an example of the present invention.
Figure 14:
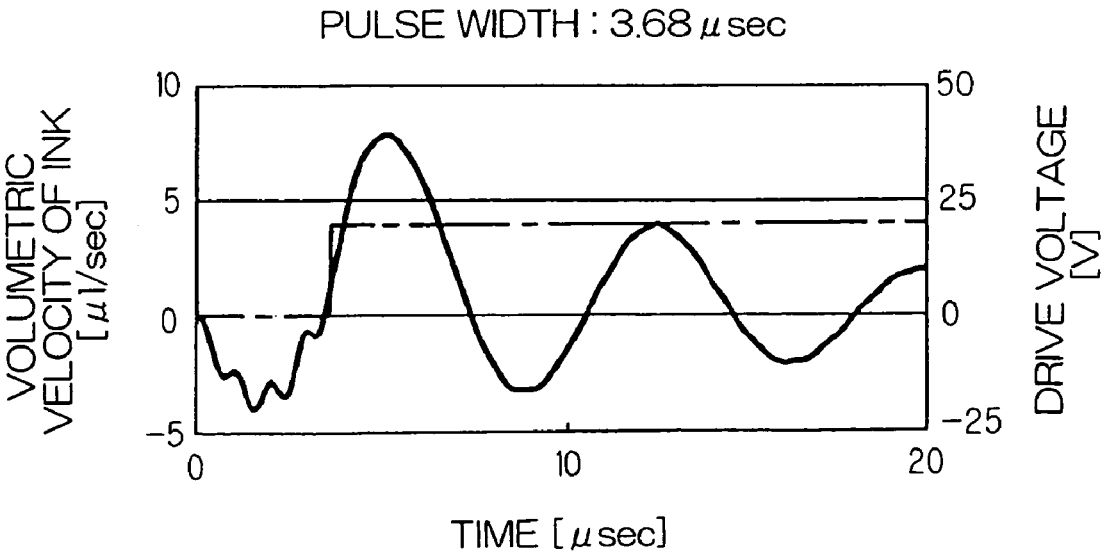
Figure 15:
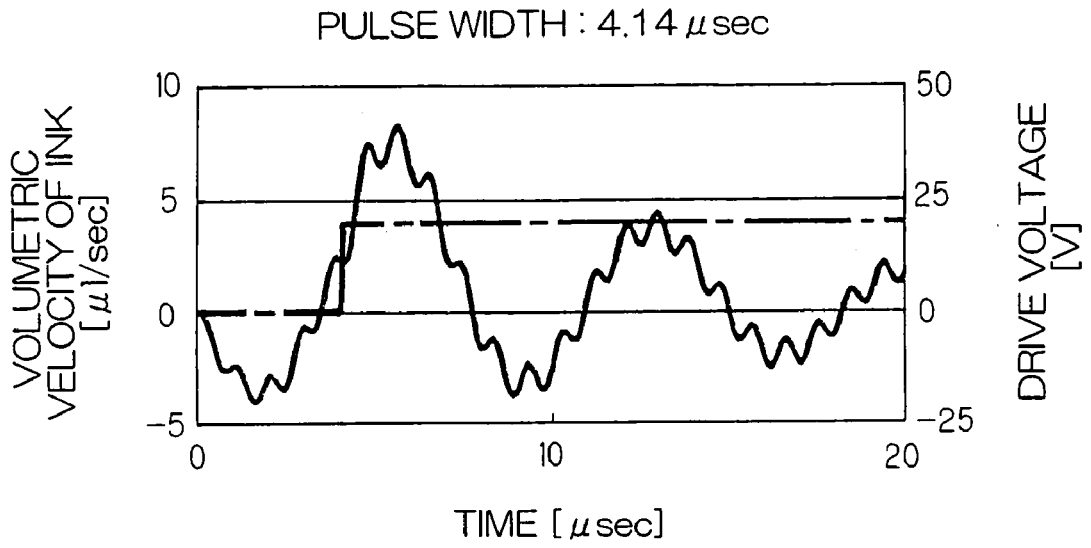
Figure 16:
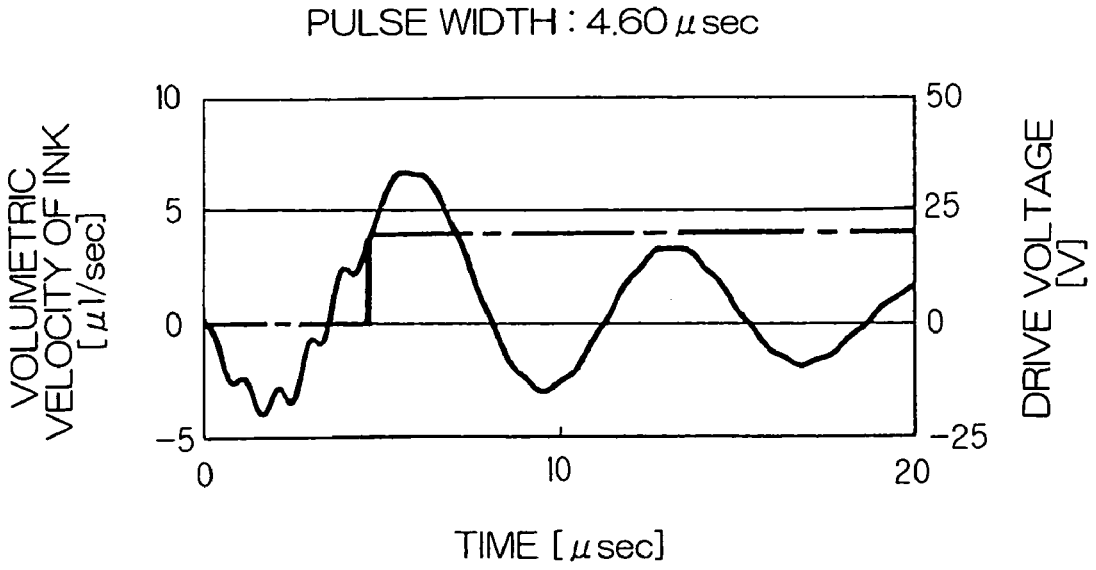

From these results, it was found that, when the pulse width $T_3$ is set at an odd number of half of the period Ta of the ensuing vibration of the drive section that is superposed on the vibration waveform of the volumetric velocity of ink in the head, the ensuing vibration is enhanced with the rise of the drive voltage waveform as shown in FIG. 13 and FIG. 15, while the ensuing vibration of the drive section superposed on the vibration of the volumetric velocity can be suppressed with the rise of the drive voltage waveform as shown in FIG. 14 and FIG. 16 when the pulse width $T_3$ is set at an even number of half periods, namely an integral multiple of the period Ta.

CONCLUSION

From the results described above, it was verified that the ensuing vibration of the drive section can be suppressed by setting the pulse width $T_3$ of the drive voltage waveform at an even number of half of the period Ta, namely an integral multiple of the period Ta of the ensuing vibration of the drive section that is superposed on the vibration waveform of the volumetric velocity of ink in the head.

What is claimed is:

1. A method for driving a piezoelectric ink jet head composed of:

a pressure chamber filled with an ink;

a nozzle that communicates with the pressure chamber and has an ink meniscus formed therein from the ink that fills the pressure chamber;

a piezoelectric element of transverse vibration mode that contracts in the direction of plane when subjected to a drive voltage applied thereto; and an oscillator plate that is stacked on the piezoelectric element so as to constitute a drive section and deflects so as to decrease the volume of the pressure chamber as the piezoelectric element contracts in the direction of plane when a voltage is applied thereto, so as to pressurize the ink in the pressure chamber and discharge an ink droplet from the tip of the nozzle, and wherein the piezoelectric ink jet head is operated by combining (A) the step of applying a drive voltage to the piezoelectric element so that the piezoelectric element contracts in the direction of plane and the oscillator plate deflects, thereby decreasing the volume of the pressure chamber, and (B) the step of removing the drive voltage applied to the piezoelectric element so that the contraction of the piezoelectric element in the direction of plane is canceled and consequently the deflection of the oscillator plate is canceled, thereby increasing the volume of the pressure chamber, thereby to discharge an ink droplet from the tip of the nozzle, characterized in that the piezoelectric element is driven with a drive voltage waveform that has at least one of the following settings:

(a) time constant $\tau_{UP}$ of rise of the drive voltage in the process (A) is set in a range that satisfies the relation of the expression (i):

$$Ta/(-ln0.01)\leqq\tau_{UP}\leqq Ta/(-ln0.25) \quad \text{(i)}$$

with respect to the period Ta of the ensuing vibration of the drive section which is superposed on the vibration waveform of the volumetric velocity of ink in the head, (b) time constant $\tau_{DN}$ of fall of the drive voltage in the process (B) is set in a range that satisfies the relation of the expression (ii):

$$Ta/(-ln0.01) \leqq \rho_{DN} \leqq Ta/(-ln0.25) \quad \text{(ii)}$$

with respect to the period Ta.

2. A method for driving the piezoelectric ink jet head of claim 1, wherein the piezoelectric ink jet head is operated as follows:

a constant drive voltage is continuously applied to the piezoelectric element during a period of standby so that the piezoelectric element is kept contracted in the direction of plane and the oscillator plate continues to deflect, thereby to maintain the pressure chamber in a state of decreased volume and, during a period of forming a dot, (1) the drive voltage is removed immediately before forming the dot so as to cancel the contraction of the piezoelectric element and relieve the oscillator plate deflection, thereby increasing the volume of the pressure chamber and pulling the ink meniscus in the nozzle back toward the pressure chamber, then (2) the drive voltage is applied again so as to cause the piezoelectric element to contract and the oscillator plate to deflect, thereby decreasing the volume of the pressure chamber and discharge an ink droplet through the tip of the nozzle.

3. A method for driving the piezoelectric ink jet head of claim 1, wherein the piezoelectric ink jet head is operated as follows:

the piezoelectric element in the state of standby is maintained in such a condition that drive voltage is not applied thereto, and during a period of forming a dot, (I) the drive voltage is applied immediately before forming the dot so as to cause the piezoelectric element to contract and the oscillator plate to deflect, thereby decreasing the volume of the pressure chamber, pushing the ink meniscus in the nozzle toward the tip of the nozzle and protruding the ink from the tip of the nozzle like a column, then (II) the drive voltage is removed again so as to cancel the contraction of the piezoelectric element and cancel the deflection of the oscillator plate, thereby increasing the volume of the pressure chamber and pulling back the ink column that has been protruding from the tip of the nozzle into the nozzle, thereby separate an ink droplet.

4. A method for driving the piezoelectric ink jet head of claim 1, wherein the time constant $\tau_{UP}$ of rise of the drive voltage in the step (A) is set in a range defined by a relation of the expression (i-1):

$$Ta/(-ln0.05) \leqq \tau_{UP} \leqq Ta/(-ln0.25) \quad \text{(i-1)}$$

with respect to the period Ta.

5. A method for driving the piezoelectric ink jet head of claim 1, wherein the time constant $\tau_{DN}$ of fall of the drive voltage in the step (B) is set in a range that satisfies the relation of the expression (ii-1):

$$Ta/(-ln0.05) \leqq \tau_{DN} \leqq Ta/(-ln0.25) \quad \text{(ii-1)}$$

with respect to the period Ta.

* * * * *